US010112394B2

(12) United States Patent
Togashi

(10) Patent No.: US 10,112,394 B2
(45) Date of Patent: Oct. 30, 2018

(54) LIQUID EJECTING HEAD UNIT AND LIQUID EJECTING APPARATUS

(71) Applicant: SEIKO EPSON CORPORATION, Tokyo (JP)

(72) Inventor: Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/428,805

(22) Filed: Feb. 9, 2017

(65) Prior Publication Data

US 2017/0232740 A1 Aug. 17, 2017

(30) Foreign Application Priority Data

Feb. 12, 2016 (JP) ..... 2016-025297

(51) Int. Cl.
*B41J 2/14* (2006.01)
*B41J 2/155* (2006.01)

(52) U.S. Cl.
CPC ..... *B41J 2/1433* (2013.01); *B41J 2/14024* (2013.01); *B41J 2/14201* (2013.01); *B41J 2/14314* (2013.01); *B41J 2/155* (2013.01); *B41J 2202/20* (2013.01)

(58) Field of Classification Search
CPC .. B41J 2/1433; B41J 2/14024; B41J 2/14201; B41J 2/155
See application file for complete search history.

(56) References Cited

U.S. PATENT DOCUMENTS

2015/0158296 A1 6/2015 Togashi
2015/0202866 A1* 7/2015 Akahane ..... B41J 2/14 347/44
2015/0258787 A1 9/2015 Togashi
2015/0258791 A1* 9/2015 Togashi ..... B41J 2/14072 347/44
2016/0067966 A1* 3/2016 Akahane ..... B41J 2/14201 347/40

FOREIGN PATENT DOCUMENTS

JP 2003-154638 A 5/2003
JP 2015-110305 A 6/2015
JP 2015-174387 A 10/2015

* cited by examiner

*Primary Examiner* — Jason S Uhlenhake
(74) *Attorney, Agent, or Firm* — Foley & Lardner LLP

(57) ABSTRACT

A liquid ejecting head unit includes: a plurality of liquid ejecting heads that have a nozzle-formed surface; and a unit base that has a bottom portion having a fixing surface to which the plurality of liquid ejecting heads are fixed, and a wall portion which extends from the bottom portion in a direction perpendicular to the fixing surface and which is continuous in a direction in which the plurality of liquid ejecting heads are aligned.

20 Claims, 16 Drawing Sheets

LIQUID EJECTING HEAD UNIT AND LIQUID EJECTING APPARATUS

BACKGROUND

1. Technical Field

The present invention relates to a liquid ejecting head unit, which includes a liquid ejecting head that ejects a liquid, and a liquid ejecting apparatus, particularly to an ink jet type recording head unit and an ink jet type recording apparatus that eject an ink as the liquid.

2. Related Art

There is proposed an ink jet type recording head unit as an example of a liquid ejecting head unit which includes ink jet type recording heads that eject ink droplets from nozzle openings through a change in pressure by a pressure generating unit, and a head fixing substrate (unit base) on which a plurality of ink jet type recording heads adhere to a side thereof opposite to a liquid ejecting surface in which the nozzle openings are formed (for example, see JP-A-2015-174387).

In such an ink jet type recording head unit, the plurality of ink jet type recording heads form a long nozzle array, thereby making it possible to increase a yield ratio and to decrease manufacturing costs, compared to a case where one ink jet type recording head forms a long nozzle array.

However, when a nozzle-formed surface of the ink jet type recording head is capped with a cap, a low load during contact brings about low sealability. Thus, problems arise in that it is not possible to perform a normal suction operation by a cap member, and inks evaporate from nozzles.

Therefore, it is possible to increase the sealability of the cap by increasing the load applied when the cap comes into contact with the nozzle-formed surface; however, since the ink jet type recording head unit holds the plurality of ink jet type recording heads such that a nozzle array elongates, the unit base is likely to elongate, particularly, stiffness in a longitudinal direction is likely to be lowered. Therefore, when the cap comes into contact with the ink jet type recording head unit with a high load, a problem arises in that the unit base is likely to be deformed.

In addition, a weight of the ink jet type recording head unit increases due to holding of the plurality of ink jet type recording heads or an increase in weight of inks, and thus a problem arises in that the unit base is deformed due to own weight.

A problem arises in that the deformation of the unit base will result in variations in positions and directions of the nozzle-formed surfaces of the plurality of ink jet type recording heads, and thus landing positions of ink droplets on an ejection target medium are shifted.

In addition, when the unit base becomes thick in order to secure the stiffness of the unit base, a problem arises in that the ink jet type recording head unit is increased in weight and size.

Note that such problems are not limited to the ink jet type recording head unit including the ink jet type recording head, but arise in a liquid ejecting head unit including a liquid ejecting head that ejects a liquid other than inks.

SUMMARY

An advantage of some aspects of the invention is to provide a liquid ejecting head unit and a liquid ejecting apparatus that have a high stiffness and are decreased in size.

According to an aspect of the invention, there is provided a liquid ejecting head unit including: a plurality of liquid ejecting heads that have a nozzle-formed surface; and a unit base that has a bottom portion having a fixing surface to which the plurality of liquid ejecting heads are fixed, and a wall portion which extends from the bottom portion in a direction perpendicular to the fixing surface and which is continuous in a direction in which the plurality of liquid ejecting heads are aligned.

In this configuration, the wall portion of the unit base makes it possible to increase the stiffness of the unit base, without increasing a thickness of the bottom portion.

In the liquid ejecting head unit, it is preferable that the plurality of liquid ejecting heads be arranged in a row. In this configuration, even when the unit base elongates with a high aspect ratio in the alignment direction of the liquid ejecting heads and thus is likely to be deformed, it is possible to increase the stiffness with the wall portion.

In the liquid ejecting head unit, it is preferable that the liquid ejecting head include a plurality of head main bodies that have nozzle openings through which inks are ejected. In this configuration, the plurality of head main bodies are likely to result in an increase in the weight of the liquid ejecting head; however, the wall portion is provided on the unit base and the stiffness of the unit base is increased. Thus, it is possible to decrease the deformation of the unit base due to the weight of the liquid ejecting head.

In the liquid ejecting head unit, it is preferable that the wall portion have a ring shape that continuously surrounds the plurality of liquid ejecting heads. In this configuration, the ring-shaped wall portion makes it possible to increase the stiffness of the unit base in a longitudinal direction, a short direction, and a torsional direction thereof.

In the liquid ejecting head unit, it is preferable that the liquid ejecting head have a head-side fixing surface which is fixed to the fixing surface of the unit base, and is positioned on a side opposite to the nozzle-formed surface. In this configuration, it is possible to decrease the unit base in size and it is possible to more increase the stiffness of the unit base.

In the liquid ejecting head unit, it is preferable that the liquid ejecting head be fixed to a plurality of positions of the unit base in a short direction. In this configuration, the fixing of the liquid ejecting heads to the unit base makes it possible to more increase the stiffness of the unit base in the short direction.

In the liquid ejecting head unit, it is preferable that the liquid ejecting head have fixing positions in both ends in the short direction, of a plurality of fixing positions thereof, which are disposed in regions of both ends in a case where the bottom portion is divided into four regions in the short direction. In this configuration, the fixing surface is provided on both end portions of the bottom portion in the short direction, and thus, the liquid ejecting heads are fixed. In this manner, it is possible to more increase the stiffness of the unit base in the short direction.

In the liquid ejecting head unit, it is preferable that the bottom portion of the unit base have a thick portion thicker than a fixing portion provided with the fixing surface and is continuous in an alignment direction of the liquid ejecting heads. In this configuration, the thick portion makes it possible to more increase the stiffness in the alignment direction of the liquid ejecting heads.

In the liquid ejecting head unit, it is preferable that the thick portion be provided with a supply hole through which a supply tube that supplies liquids to the liquid ejecting head penetrates. In this configuration, the supply hole in the thick portion makes it possible to less decrease the stiffness due to the supply hole.

In the liquid ejecting head unit, it is preferable that, in a case where the nozzle-formed surface is viewed in a plan view, the fixing surface be disposed at a position which is overlapped with a seal portion of a cap with respect to the nozzle-formed surface. In this configuration, even when the cap comes into contact with the nozzle-formed surface due to a high load, the fixing surface of the unit base can receive the load of the cap, and thus it is possible to decrease the deformation or the positional shift of the liquid ejecting head due to the load of the cap.

In the liquid ejecting head unit, it is preferable that the liquid ejecting head be configured to include stacked members and the wall portion cover an interface of the stacked members. In this configuration, the covering of the interface with the wall portion makes it possible to protect the interface. In particular, a wiring substrate or an adhesive on the interface is covered with the wall portion, and thereby it is possible to decrease an amount of a liquid that is attached to the wiring substrate or the adhesive.

In the liquid ejecting head unit, it is preferable that the bottom portion be provided with a cable opening through which a cable connected to the liquid ejecting head passes. In this configuration, the cable opening in the bottom portion makes it possible to decrease an amount of mists of a liquid on the nozzle-formed surface side which infiltrates from the cable opening.

In the liquid ejecting head unit, it is preferable that the unit base have a step on an outer side of the wall portion, which accommodates a relay substrate that is common to and is electrically connected to the plurality of liquid ejecting heads. In this configuration, the step can make it difficult for mists of liquids on the nozzle-formed surface side to be attached to the relay substrate.

According to another aspect of the invention, there is provided a liquid ejecting apparatus including: the liquid ejecting head unit described above.

In this configuration, it is possible to realize a liquid ejecting apparatus which has an increase in durability and a decrease in size.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described on the basis of embodiments.

Embodiment 1

Figure 1:
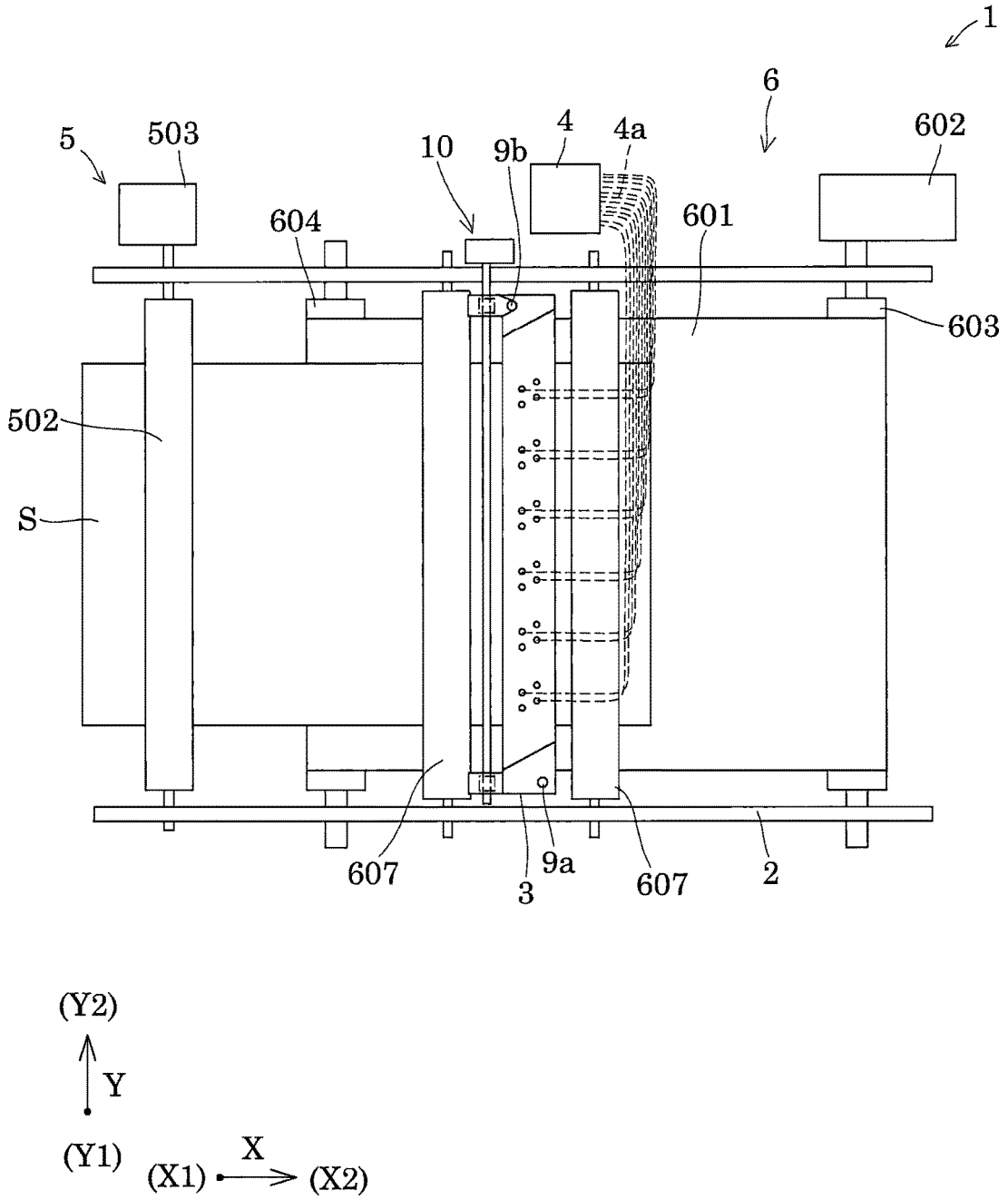
FIG. 1 is a top view illustrating a schematic configuration of a recording apparatus according to Embodiment 1 of the invention.
Figure 2:
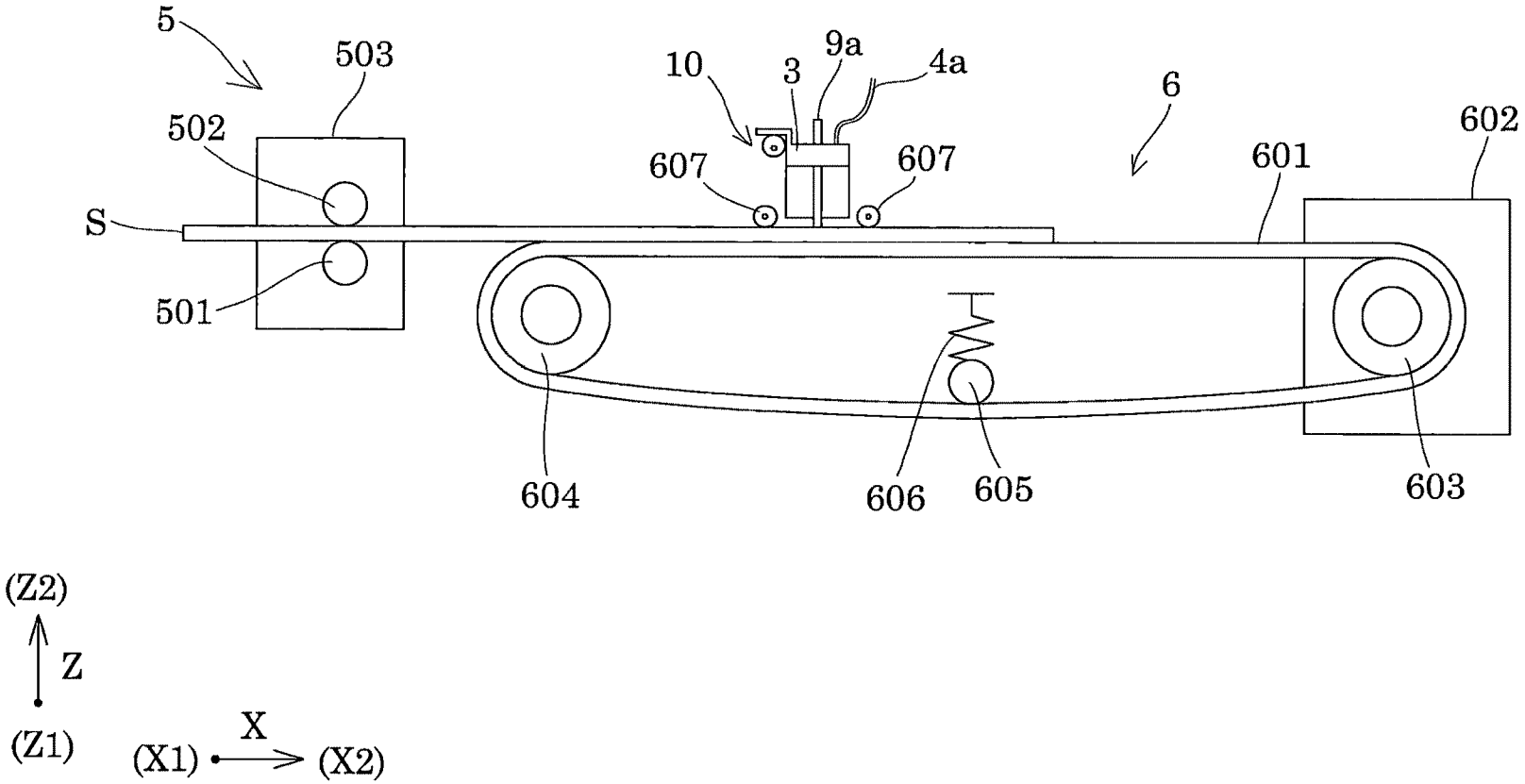
FIG. 2 is a side view illustrating the schematic configuration of the recording apparatus according to Embodiment 1 of the invention.

FIG. 1 is a top view illustrating a schematic configuration of an ink jet type recording apparatus as an example of a liquid ejecting apparatus according to Embodiment 1 of the invention. FIG. 2 is a side view illustrating the ink jet type recording apparatus.

As illustrated in FIGS. 1 and 2, an ink jet type recording apparatus 1 as an example of the liquid ejecting apparatus of the embodiment is a so-called line type recording apparatus 1 that transports a recording sheet S as an ejection target medium and performs printing.

Here, in the embodiment, a transport direction of the recording sheet S is referred to as a first direction X, and a direction orthogonal to the first direction X in an in-plane direction of a surface of the recording sheet S, on which an ink lands, is referred to as a second direction Y. In addition, a direction orthogonal to both of the first direction X and the second direction Y, that is, a direction orthogonal to the surface of the recording sheet S on which the ink lands, is referred to as a third direction Z. Further, in the third direction Z, the recording sheet S side is referred to as Z1, and the ink jet type recording head unit side is referred to as Z2. In the embodiment, an example, in which the directions (X, Y, and Z) are orthogonal to one another, is described; however, the definitions of the directions are not necessarily limited thereto.

The ink jet type recording apparatus 1 includes an apparatus main body 2, an ink jet type recording head unit 3 (hereinafter, also simply referred to as a head unit 3) provided to be able to be lifted and lowered with respect to the apparatus main body 2 in the third direction Z, a liquid storing unit 4 such as an ink tank in which an ink as a liquid is stored, and a first transport unit 5 and a second transport unit 6 that transport the recording sheet S.

The head unit 3 extends in the second direction Y. In the embodiment, the head unit 3, which will be described below in detail, includes a plurality of ink jet type recording heads 100 (hereinafter, also simply referred to as a recording head 100) that discharge an ink, and a unit base 200 that holds the plurality of recording heads 100.

The liquid storing unit 4 supplies an ink to the head unit 3 and is fixed to the apparatus main body 2, in the embodiment. The ink from the liquid storing unit 4 fixed to the apparatus main body 2 is supplied to the head unit 3 via a supply tube 4*a* such as a tube. Note that an example, in which the head unit 3 includes the liquid storing unit 4, for example, the liquid storing unit 4 is mounted above the head unit 3 on the Z2 side, may be employed.

The first transport unit 5 is provided on one side of the head unit 3 in the first direction X, and thus on an X1 side in the embodiment. Note that, in the embodiment, an upstream side from the head unit 3 in the transport direction in the first direction X is referred to as the X1 side, and a downstream side is referred to as an X2 side.

The first transport unit 5 includes a first transport roller 501 and a first driven roller 502 that is driven by following the first transport roller 501. The first transport roller 501 is provided on a side opposite to the surface of the recording sheet S on which the ink lands, that is, on the Z1 side, and is driven by a drive force from the first drive motor 503. In addition, the first driven roller 502 is provided on the surface side of the recording sheet S on which the ink lands, that is, on the Z2 side, and the recording sheet S is nipped between the first transport roller 501 and the first driven roller 502. The first driven roller 502 presses the recording sheet S toward the first transport roller 501 with a bias member such as a spring not illustrated.

The second transport unit 6 includes a transport belt 601, a second drive motor 602, a second transport roller 603, a second driven roller 604, a tension roller 605, and a pressing roller 607.

The second transport roller 603 of the second transport unit 6 is driven by a drive force from the second drive motor 602. The transport belt 601 is formed of an endless belt and loops around outer circumferences of the second transport roller 603 and the second driven roller 604. The transport belt 601 is provided on the Z1 side of the recording sheet S. The tension roller 605 is provided between the second transport roller 603 and the second driven roller 604, comes into contact with an inner circumferential surface of the transport belt 601, and applies tension to the transport belt 601 due to a bias force from a bias member 606 such as a spring. In this manner, the transport belt 601 is disposed between the second transport roller 603 and the second driven roller 604 so as to have a flat surface facing the head unit 3.

The pressing rollers 607 of the second transport unit 6 are provided on the X1 side and the X2 side of the head unit 3, respectively, on the Z2 side of the recording sheet S. The recording sheet S is interposed between the two pressing rollers 607 and the transport belt 601, and thereby a flat posture of the recording sheet S is maintained.

In the ink jet type recording apparatus 1, while the first transport unit 5 and the second transport unit 6 transport the recording sheet S with respect to the head unit 3 from the X1 side to the X2 side in the first direction X, the ink is caused to be ejected from the recording heads 100 of the head unit 3, the ejected ink is caused to land on a surface of the recording sheet S on the Z2 side, and so-called printing is performed.

Figure 3:
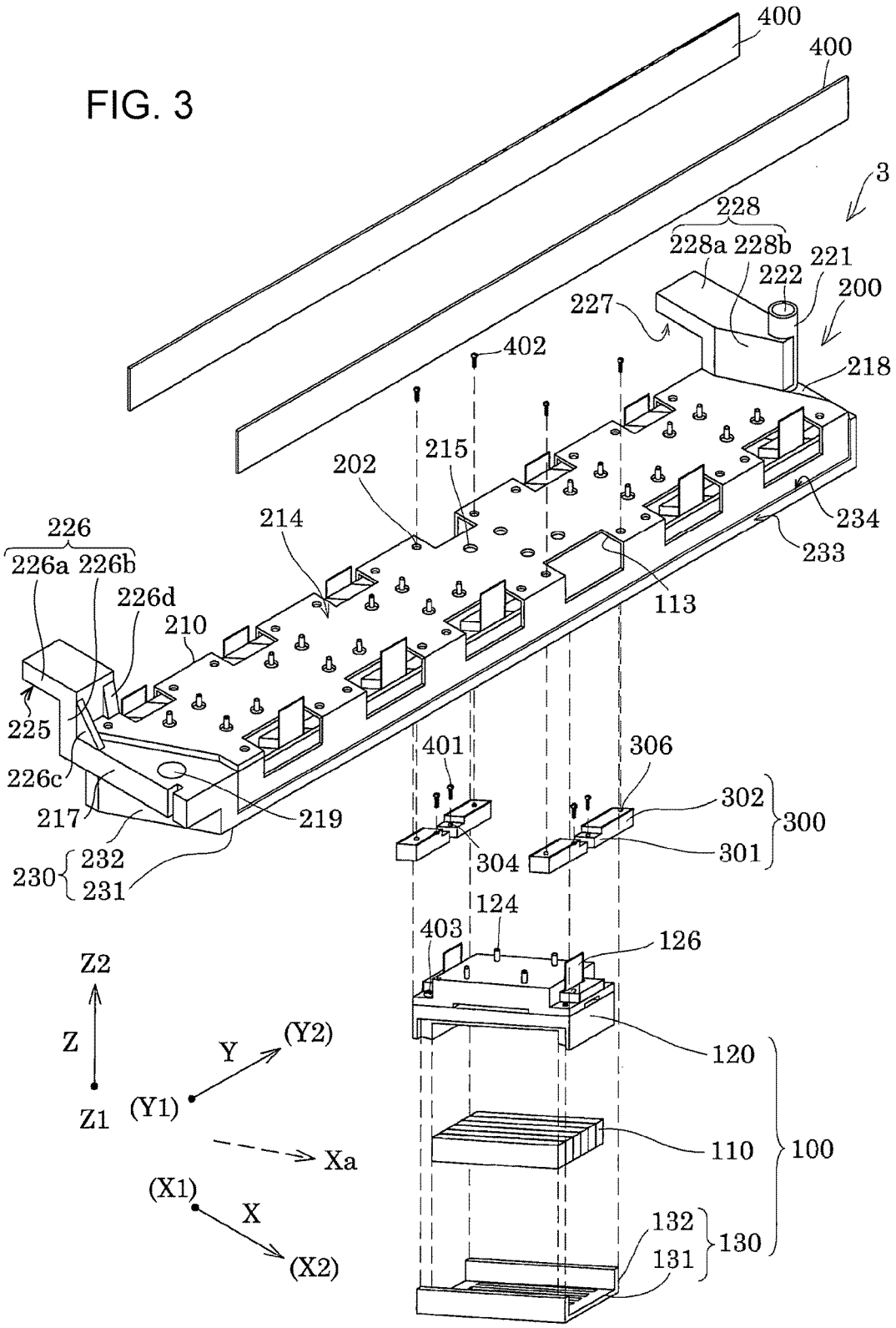
FIG. 3 is an exploded perspective view illustrating a part of a head unit according to Embodiment 1 of the invention.
Figure 4:
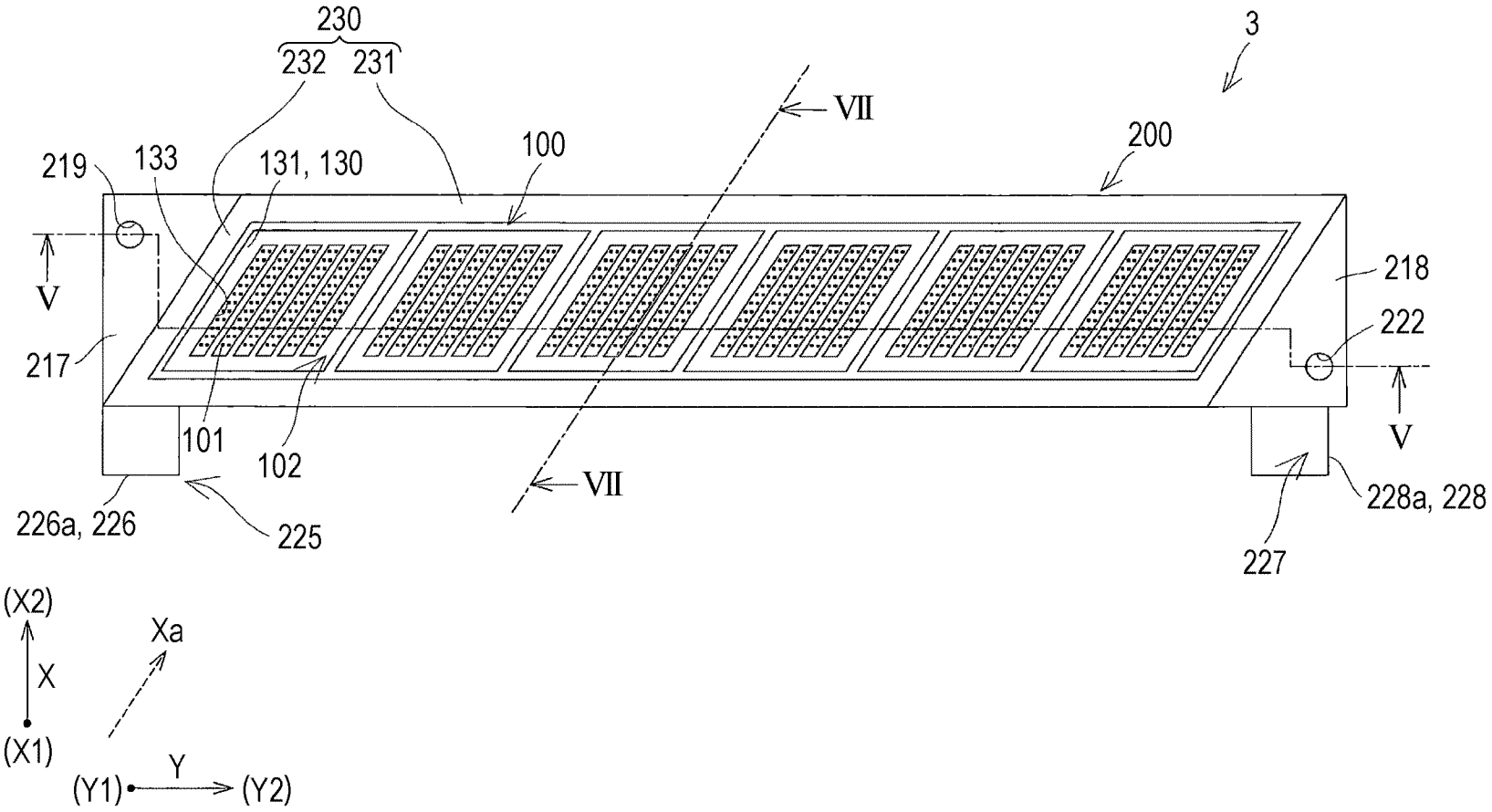
FIG. 4 is an underside view illustrating the head unit according to Embodiment 1 of the invention.
Figure 5:
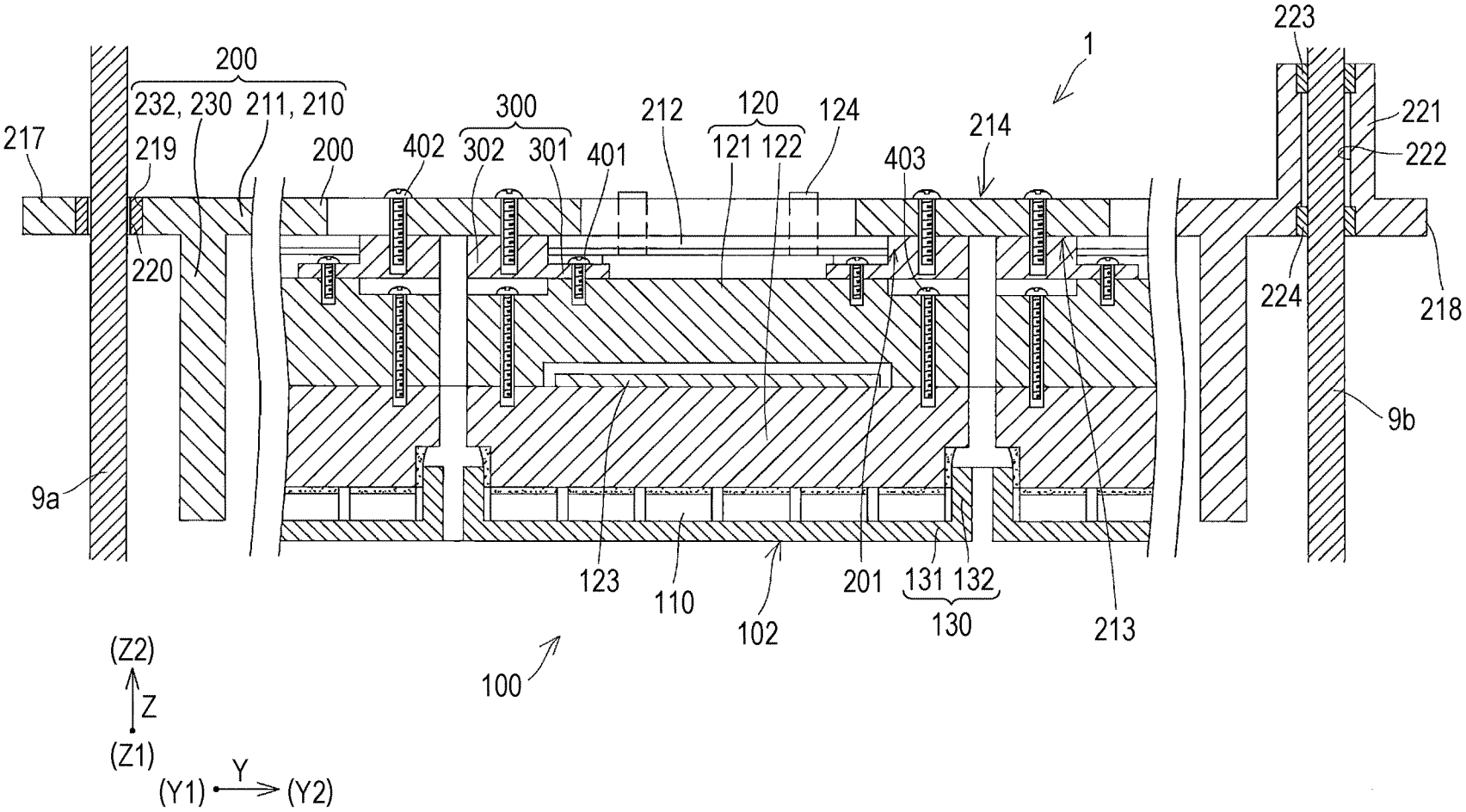
FIG. 5 is a sectional view illustrating the head unit according to Embodiment 1 of the invention.
Figure 6:
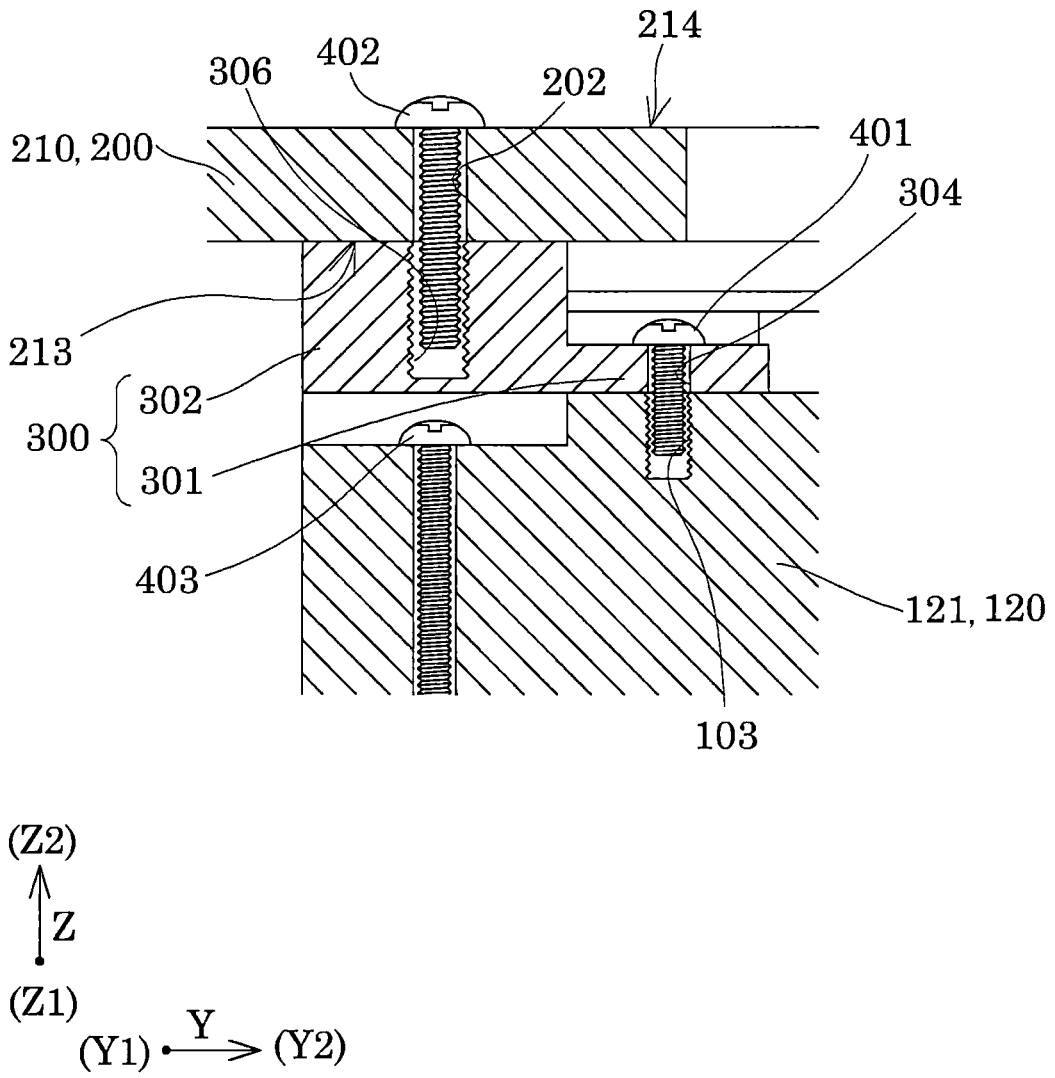
FIG. 6 is an enlarged sectional view illustrating a main part of the head unit according to Embodiment 1 of the invention.
Figure 7:
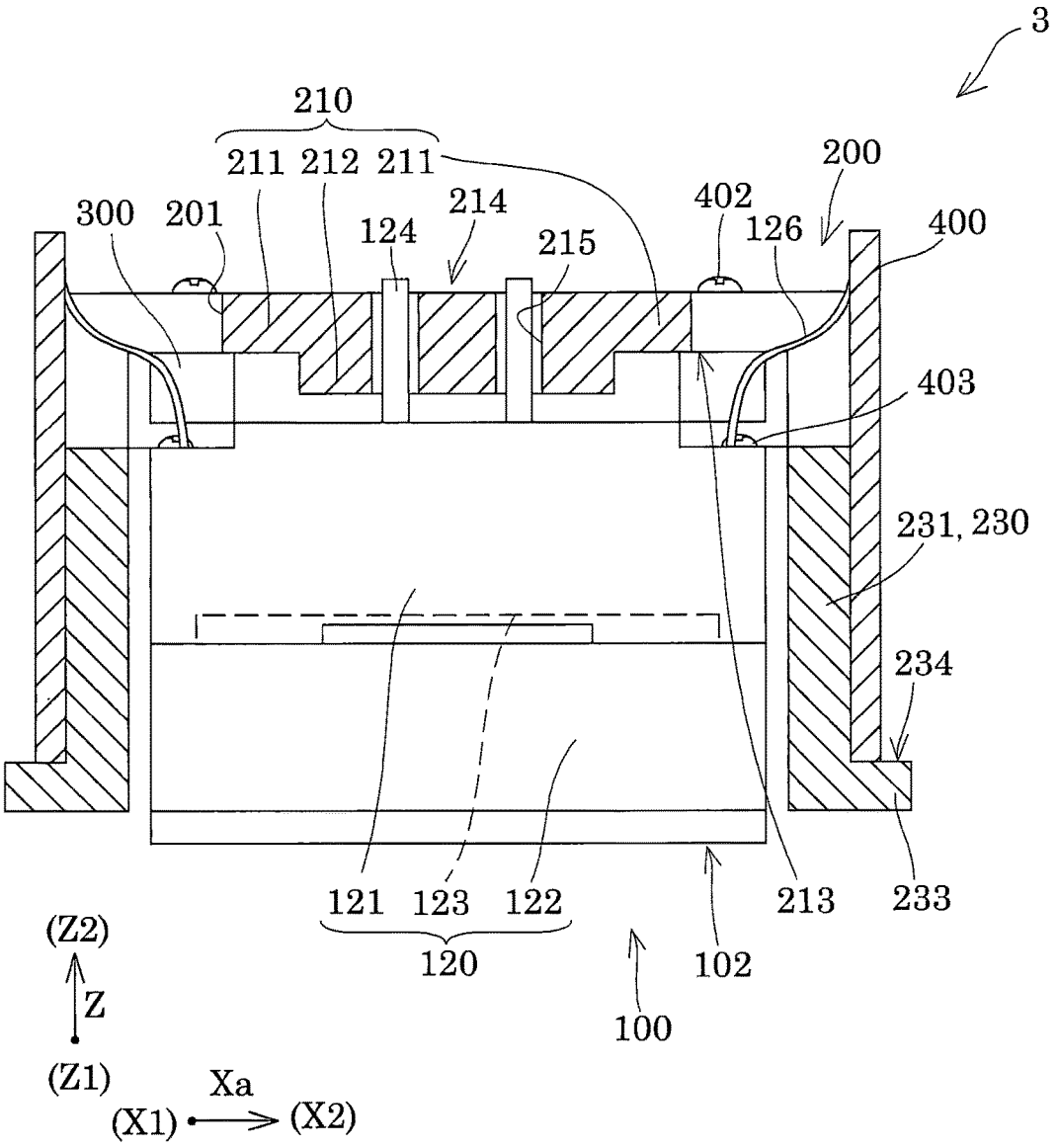
FIG. 7 is a sectional view illustrating the head unit according to Embodiment 1 of the invention.

Here, the head unit 3 that is mounted in the ink jet type recording apparatus 1 is more described in detail with reference to FIGS. 3 to 7. FIG. 3 is an exploded perspective view illustrating a part of the ink jet type recording head unit as an example of a liquid ejecting head unit according to Embodiment 1 of the invention. FIG. 4 is an underside view illustrating the head unit. FIG. 5 is a sectional view taken along line V-V in FIG. 4. FIG. 6 is an enlarged view illustrating a main part in FIG. 5. FIG. 7 is a sectional view taken along line VII-VII in FIG. 4. In addition, in the embodiment, the directions of the head unit 3 are described, based on directions obtained when the head unit is mounted in the ink jet type recording apparatus 1, that is, the first direction X, the second direction Y, and the third direction Z.

As illustrated in FIGS. 3 to 7, the head unit 3 of the embodiment includes the plurality of recording heads 100, the unit base 200 that holds the plurality of recording heads 100, and a spacer 300 provided between the unit base 200 and the recording head 100.

As illustrated in FIG. 4, the recording head 100 includes a nozzle-formed surface 102 having nozzle openings 101 in the surface on the Z1 side. The nozzle openings 101 are fixed such that a nozzle array is inclined with respect to the first direction X in the in-plane direction of the nozzle-formed surface 102. In other words, an alignment direction of the nozzle openings 101 that form the nozzle array is referred to as a fourth direction Xa inclined with respect to the first direction X. In addition, a plurality of nozzle arrays are provided side by side on the nozzle-formed surface 102 in the second direction Y.

In addition, the recording head 100 has a substantially parallelogramic shape in the second direction Y and the fourth direction Xa, in a plan view from the nozzle-formed surface 102 side. It is needless to say that the shape of the recording head 100 is not limited to the substantially parallelogram; however, the recording head may have a rectangular shape, a trapezoidal shape, a polygonal shape, or the like, in a plan view from the nozzle-formed surface 102 side.

Further, the plurality of recording heads 100 are aligned in the second direction Y orthogonal to the first direction X as the transport direction of the recording sheet S, and are fixed to the unit base 200. Note that, in the embodiment, the plurality of recording heads 100 are aligned in the second direction Y, that is, are aligned in a straight line in the second direction Y. In other words, the plurality of recording heads 100 are not disposed to be shifted from one another in the first direction X. In this manner, it is possible to decrease a width of the head unit 3 in the first direction X, and thus it is possible to decrease the head unit 3 in size. Note that, in the embodiment, the recording heads 100 are aligned in the second direction Y, and thereby the head unit 3 has an elongated length in the second direction Y, and has a short length in the first direction X. In other words, the head unit 3 has a longitudinal direction in the second direction Y and has a short direction in the first direction X.

The recording head 100 is configured to include a plurality of members which are stacked. Specifically, as illustrated in FIGS. 3 and 5, in the embodiment, the recording head 100 includes a plurality of head main bodies 110 provided with the plurality of nozzle openings 101 from which ink droplets are discharged, holding members 120 that hold the plurality of head main bodies 110, and covers 130 as fixing plates provided on the Z1 side of the head main bodies 110. The head main body 110, the holding member 120, and the cover 130 are stacked in the third direction Z. In the embodiment, in the recording head 100, a surface on the Z1 side is referred to as the nozzle-formed surface 102.

In addition, the holding member 120 includes a flow-path member 121, a holder 122, and a wiring substrate 123 held between the flow-path member 121 and the holder 122. The wiring substrate 123 is provided to be exposed on a stack interface between the flow-path member 121 and the holder 122. In addition, a cable 126 connected to the wiring substrate 123 is guided out through a surface of the recording head 100 on the Z2 side.

The plurality of recording heads 100 are fixed to the unit base 200. In the embodiment, six recording heads 100 are fixed to unit base 200 via the spacer 300.

As illustrated in FIG. 6, the spacer 300 includes a first fixing portion 301 and a second fixing portion 302 which is thicker than the first fixing portion 301 in the third direction Z.

The first fixing portion 301 is provided with a first insertion hole 304 that penetrates therethrough in the third direction Z. In addition, the recording head 100 is provided with a first fixing hole 103. A first screw member 401 as a male screw is inserted into the first insertion hole 304 from the Z2 side of the first fixing portion 301 and the first screw member 401 is screwed with the first fixing hole 103 of the recording head 100, and thereby the spacer 300 is fixed to the surface of the recording head 100 on the Z2 side.

The spacer 300 is disposed at a position which is placed within the outer shape of the recording head 100 in the second direction Y as an alignment direction of the recording heads 100, in a plan view of the nozzle-formed surface 102. In other words, the spacer 300 is disposed at a position which does not project from the outer shape of the recording head 100 in the second direction Y, when viewed in the third direction Z. Note that the outer shape of the recording head 100 means portions of the recording head 100 which project to the largest extent in the first direction X and the second direction Y.

When the recording head 100 is viewed in the third direction Z, the spacer 300 is disposed at a position which does not project from a side surface of the recording head 100 in the second direction Y, and thereby it is possible to decrease a gap between the recording heads 100 which are adjacent to each other in the second direction Y. In this manner, the head main bodies 110 of the recording heads 100, which are adjacent to each other in the second direction Y, can be provided to approach each other, and the nozzle openings 101 provided in the head main bodies 110 of the adjacent recording heads 100 can be provided to approach each other in the second direction Y. As a result, it is possible to continuously form the heads of the head unit 3, which are aligned at equal intervals in the second direction Y.

In addition, in the embodiment, the spacer 300 is disposed at a position which is placed within the outer shape of the recording head 100 on the nozzle-formed surface 102 side in a relative moving direction of the recording sheet S with respect to the head unit 3, that is, in the first direction X as a transport direction of the recording sheet S, in a plan view of the nozzle-formed surface 102. In this manner, it is possible to decrease the width of the head unit 3 in the first direction X, and it is possible to decrease a distance between the two pressing rollers 607 in the first direction X in the ink jet type recording apparatus 1. Hence, it is possible to decrease a space between the two pressing rollers 607 in the first direction X, and thus it is easy to fix the posture of the recording sheet S between the two pressing rollers 607 such that it is possible to improve print quality. In addition, it is possible to decrease the head unit 3 and the ink jet type recording apparatus 1 in size.

The spacer 300 is detachably fixed in a state in which the second fixing portion 302 is in contact with a surface of the unit base 200 on the Z1 side as the recording sheet S side. Specifically, the second fixing portion 302 of the spacer 300 is provided with a second fixing hole 306 that opens to the unit base 200 side. In addition, the unit base 200 is provided with a second insertion hole 202. A second screw member 402 as a male screw is inserted into the second insertion hole from the Z2 side of the unit base 200 and the second screw member 402 is screwed into the second fixing hole 306 of the spacer 300, and thereby the spacer 300 is fixed in a state of being in contact with a surface of the unit base 200 on the Z1 side. In other words, the spacer 300 is detachably fixed by being screwed with the second screw member 402 from the Z2 side of the unit base 200. The spacer 300 of the embodiment is released from the screwing with the second screw member 402, and thereby it is possible to detach the spacer 300 from the unit base 200 at a desirable timing.

As described above, the spacer 300 fixed to the recording head 100 is detachably provided in the unit base 200, and thereby it is possible to easily attach or detach the recording head 100 to and from the unit base 200. In this manner, when the plurality of recording heads 100 provided in the head unit 3 malfunction, it is possible to selectively replace only the malfunctioning recording head 100. In other words, since there is no need to replace the entire head unit 3 in response to the malfunction of one recording head 100, it is possible to decrease costs. In addition, also during assembly of the head unit 3, it is possible to selectively replace a recording head 100 which does not have the same ejection characteristics of ink droplets, and thus, it is possible to increase a yield ratio.

In addition, in the embodiment, the first screw member 401, which fixes the recording head 100 and the spacer 300, and the second screw member 402, which fixes the unit base 200 and the spacer 300, are detachably fixed by being screwed from a side opposite to the nozzle-formed surface 102 of the recording head 100. Hence, it is possible to decrease an occurrence of a problem arising in that an ink attached to the first screw member 401 or the second screw member 402 drops down on the recording sheet S or the like at an unexpected timing. In addition, the first screw member 401 and the second screw member 402 have the same direction of screwing, and thus are screwed with good workability.

Note that, in the embodiment, one recording head 100 is provided with four spacers 300. Specifically, the spacers 300 are provided on four corners of a surface of the recording head 100, respectively, in the first direction X and the second direction Y.

In addition, a plurality of types of spacers 300, which have different thicknesses, can be used and can adjust relative heights of the plurality of recording heads 100 in the third direction Z, and thereby it is possible to easily adjust to have the same heights and inclinations of the nozzle-formed surface 102 of the plurality of recording heads 100. In particular, in the embodiment, the spacer 300 is attachable to and detachable from the recording head 100, and thereby it is possible to easily perform replacement with the spacer 300 having a different thickness. Hence, it is possible to decrease a shift of a landing position of ink droplets which are ejected from the recording heads 100 such that it is possible to improve the print quality.

Figure 8:
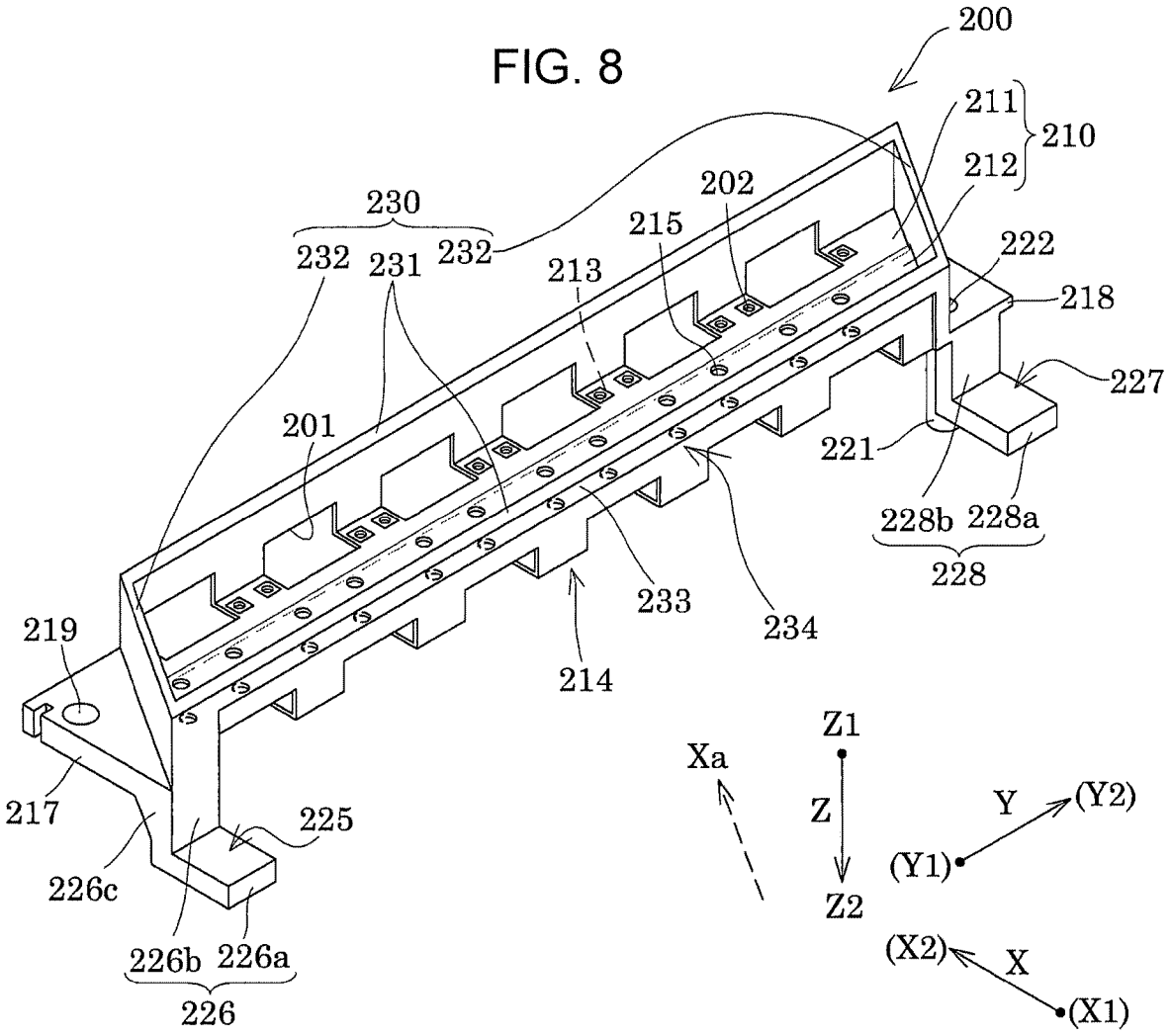
FIG. 8 is a perspective view illustrating a unit base when viewed from a Z1 side according to Embodiment 1 of the invention.
Figure 9:
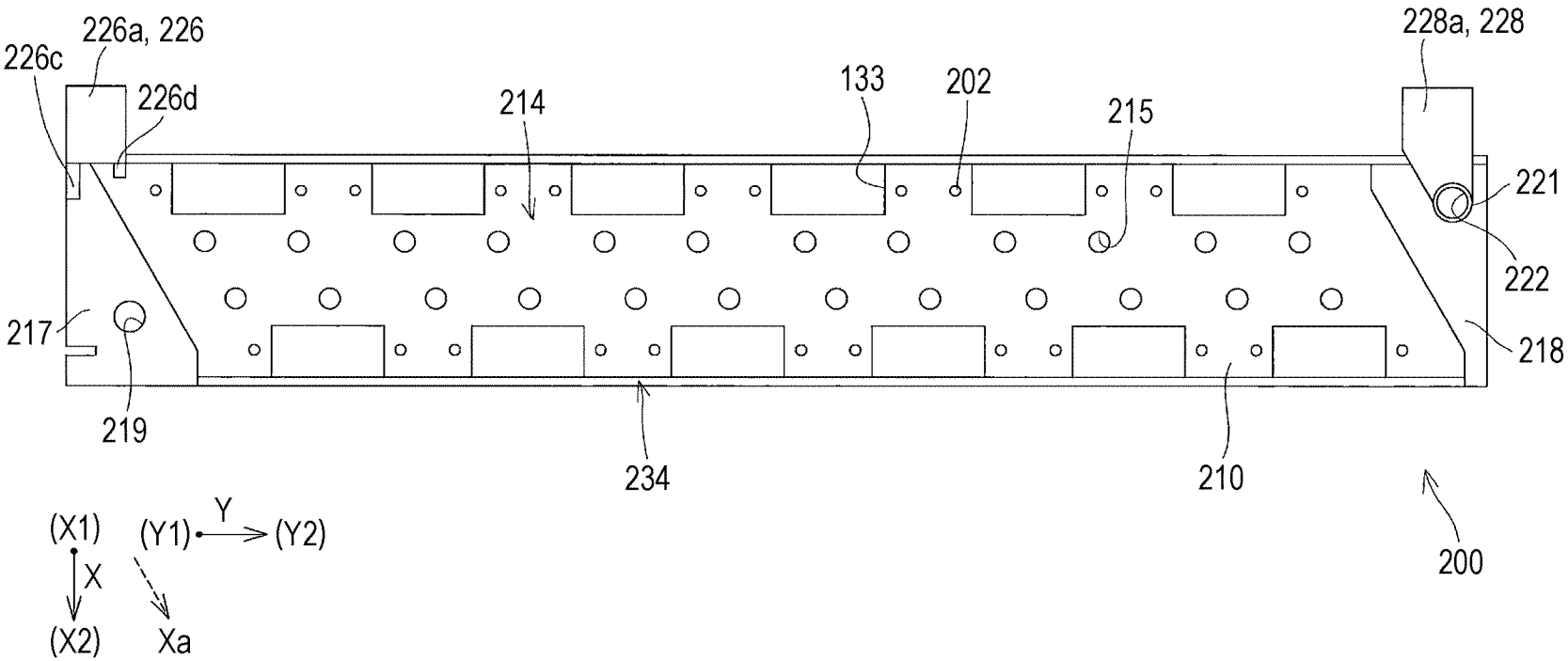
FIG. 9 is a top view illustrating the unit base according to Embodiment 1 of the invention.
Figure 10:
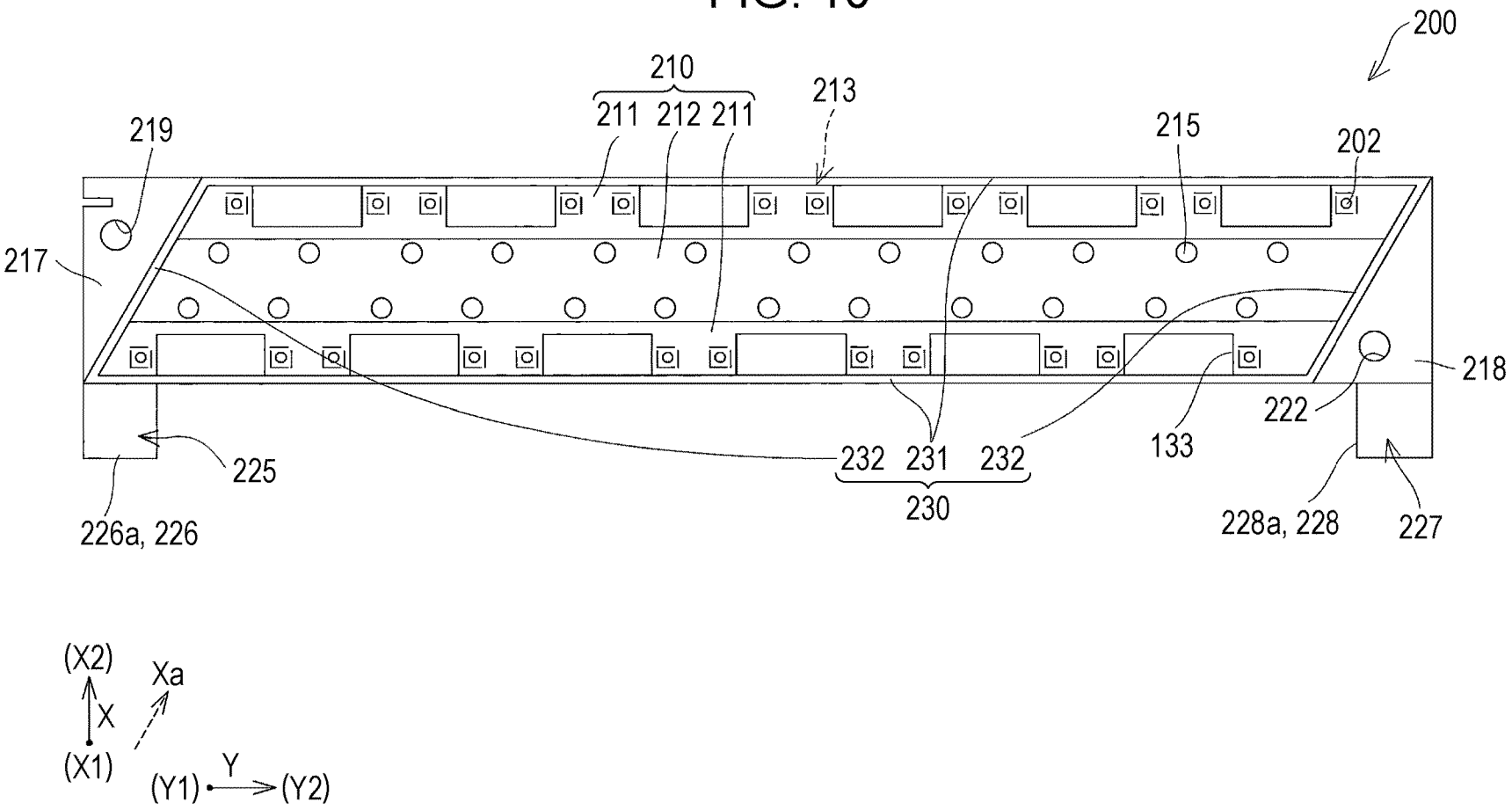
FIG. 10 is an underside view illustrating the unit base according to Embodiment 1 of the invention.

The unit base 200, to which the recording heads 100 are fixed via the spacers 300, is more described with reference to FIGS. 8 to 10. FIG. 8 is a perspective view illustrating the unit base 200 when viewed from an underside of the unit base. FIG. 9 is a top view illustrating the unit base. FIG. 10 is an underside view illustrating the unit base.

As illustrated in FIGS. 8 to 10, the unit base 200 includes a bottom portion 210, and a wall portion 230 provided on the Z1 side of the bottom portion 210. For example, it is possible to form the unit base 200 through cutting work or molding, using metal such as an aluminum alloy or a resin.

The bottom portion 210 has a plate shape with a plane direction including a first direction X and the second direction Y, and includes fixing portions 211 provided on both sides in the first direction X and a thick portion 212 that is provided between the fixing portions 211 and is thicker than the fixing portion 211. The two fixing portions 211 and the thick portion 212 interposed between the two fixing portions 211 are provided to be continuous in the second direction Y. In addition, the fixing portions 211 and the thick portion 212 are integrally provided.

The fixing portion 211 includes a fixing surface 213 having a surface of the fixing surface on the Z1 side, to which the recording head 100 is fixed via the spacer 300. Note that, in the embodiment, a surface of the bottom portion 210, which is opposite to the fixing surface 213 to which the recording head 100 is fixed, that is, a surface on the Z2 side, is referred to as a supply surface 214.

The fixing portion 211 of the bottom portion 210 is provided with the second insertion hole 202 that penetrates therethrough in the third direction Z. The second screw member 402 inserted into the second insertion hole 202 from the supply surface 214 side is screwed as described above, and thereby the spacer 300 fixed to the recording head 100 is fixed to the fixing surface 213. Note that, as described above, one recording head 100 is provided with four spacers 300. In other words, the recording head 100 is fixed at total of four positions of two positions in the fixing portions 211, respectively, which are disposed to interpose the thick portion 212 in the first direction X. In other words, the recording head 100 are fixed to unit base 200 at a plurality of positions in the first direction X as a short direction of the unit base. As described above, the recording head 100 is fixed to the unit base 200 at the plurality of positions in the first direction X, and thereby it is possible to increase the stiffness of the unit base 200 in the short direction, with the recording head 100 fixed to the unit base 200. In addition, it is preferable that the fixing surfaces 213 in the unit base 200, to which the spacers 300 fixing both ends of the recording head 100 the first direction X as the short direction of the unit base 200 are fixed, be disposed in both end regions in a case where the bottom portion 210 is divided into four regions in the first direction X as the short direction. As described above, the fixing surfaces 213, to which the spacers 300 are fixed, are provided in both end portions of the bottom portion 210 in the short direction, and thereby it is possible to increase the stiffness of the unit base 200 in the short direction, with the recording head 100 fixed to the unit base.

In addition, the thick portion 212 of the bottom portion 210 is provided with a supply hole 215 that penetrates therethrough in the third direction Z. A flow path of the recording head 100 fixed to the bottom portion 210 is exposed through the supply hole 215 in the supply surface 214 side and the exposed flow path through the supply hole 215 is connected with the supply tube 4*a* such as a tube from the supply surface 214 side (refer to FIG. 1). In other words, inks are supplied to the recording head 100 from the supply surface 214 side. Note that, in the embodiment, the supply tube 4*a* is directly connected to the recording head 100 from the supply surface 214 side of the bottom portion 210; however, the configuration is not particularly limited thereto, and another flow-path member may be provided on the supply surface 214 side of the bottom portion 210, the supply tube 4*a* may be connected to the other flow-path member, and the ink may be supplied to the recording head 100 from the supply tube 4*a* via the other flow-path member. In the embodiment, the supply hole 215 is provided in the thick portion 212, and thereby it is possible to prevent a significant decrease in the stiffness of the bottom portion 210, and thus it is possible to secure the stiffness of the bottom portion 210. In other words, in a case where the supply hole 215 is provided in the fixing portion 211, the stiffness of a portion of the fixing portion 211, in which the supply hole 215 is provided, is significantly decreased because the fixing portion 211 is thinner than the thick portion 212.

Since the plurality of recording heads 100 are aligned in the second direction Y and are fixed to the bottom portion 210, the bottom portion 210 has a long length (a longitudinal direction) in the second direction Y, and the bottom portion 210 has a short length (a short direction) in the first direction X. The bottom portion 210 is provided with the thick portion 212, and thereby it is possible to increase the stiffness of the bottom portion 210. In particular, since the bottom portion 210 has the long length in the second direction Y, the thick portion 212 is provided in the second direction Y, and thereby it is possible to increase the stiffness in the longitudinal direction in which the stiffness is likely to be decreased.

The wall portion 230 includes two first wall portions 231 provided to be continuous in the second direction Y as the alignment direction of the recording heads 100, and two second wall portions 232 that connects the two first wall portions 231 to each other. In other words, the wall portion 230 has a ring shape in which the two first wall portions 231 and the two second wall portions 232 are formed to be a continuous wall.

Specifically, the first wall portions 231 are formed of a plate-like member and are provided to be upright in both end portions of the bottom portion 210 in the first direction X, respectively, so as to extend from the bottom portion 210 on the Z1 side in a direction perpendicular to the fixing surface 213, that is, the third direction Z. In addition, the first wall portion 231 is provided to be continuous in the second direction Y as the alignment direction of the recording heads 100. In other words, the first wall portion 231 is formed of the plate-like member and is disposed so as to have a front surface that is formed in directions including the second direction Y and the third direction Z.

The second wall portions 232 are provided to be upright in both end portions of the bottom portion 210 in the second direction Y, respectively, so as to extend from the bottom portion on the Z1 side in a direction perpendicular to the fixing surface 213, that is, the third direction Z. In addition, the second wall portion 232 is provided to be continuous in an inclined direction with respect to the first direction X, that is, in the fourth direction Xa as the alignment direction of the nozzle openings 101 of the recording heads 100 in the embodiment. In other words, the second wall portion 232 is formed of a plate-like member and is disposed so as to have a front surface that is formed in directions including the fourth direction Xa and the third direction Z.

In addition, end portions of the first wall portions 231 and the second wall portions 232 are connected to each other. In the embodiment, the first wall portions 231 and the second wall portions 232 are integrally provided to be a continuous wall. Hence, the wall portion 230 is formed to have a ring shape surrounding the plurality of recording heads 100 by the two first wall portions 231 and the two second wall portions 232.

The ring-shaped wall portion 230 makes it possible to increase the stiffness of the unit base 200. In other words, the first wall portion 231 makes it possible to increase the stiffness of the unit base against the bending moment in the second direction Y, compared to a case where only the bottom portion 210 is provided as the unit base 200. In other words, the second wall portion 232 makes it possible to increase the stiffness of the bottom portion 210 against the bending moment in the first direction X. The first wall portion 231 and the second wall portion 232 make it possible to increase the stiffness of the unit base against the torsional moment. In the embodiment, the wall portion 230 has the ring shape with the first wall portions 231 and the second wall portions 232 formed as a continuous wall, and thereby it is possible to increase the stiffness against the bending moment in the first direction X and the second direction Y, and to increase the stiffness against the torsional moment. Hence, even when a load is increased, with a cap coming into contact with the nozzle-formed surface 102 of the head unit 3, it is possible to decrease deformation of the unit base 200. Since it is possible to decrease the deformation of the unit base 200, it is possible to increase the load produced when the cap comes into contact with the nozzle-formed surface 102. Then, it is possible to increase sealing performance between the cap and the nozzle-formed surface 102 such that it is possible to reliably perform a suction operation via the cap. In addition, it is possible to increase the load produced when the cap comes into contact with the nozzle-formed surface 102, and then it is possible to increase the sealing performance between the cap and the nozzle-formed surface such that it is possible to decrease an amount of inks evaporating from the nozzle openings 101. Further, even when the head unit 3 holds the plurality of recording heads 100 and thus a weight of the head unit is increased, it is possible to increase the stiffness of the unit base 200 such that it is possible to decrease deformation or damage to the unit base due to the own weight.

In addition, in the embodiment, since the recording heads 100 are arranged in a row in the second direction Y, the unit base 200 is likely to be long in the second direction Y with a high aspect ratio. However, the wall portion 230, which is continuous in the alignment direction of the recording heads 100 on the unit base 200, particularly the first wall portion 231, makes it possible to increase the stiffness of the unit base 200 in the longitudinal direction in which the unit base is likely to be deformed.

Further, in the embodiment, as described above, since the spacer 300 fixed to the recording head 100 is fixed to be screwed into the unit base 200 from the side opposite to the fixing surface 213 on the Z1 side, the spacer 300 does not project on the nozzle-formed surface 102 of the recording head 100 in the second direction Y, and thus it is possible to dispose the spacer 300 within the outer shape of the recording head 100 in the second direction Y. Hence, it is possible to decrease the interval between the recording heads 100 which are aligned in the second direction Y and are adjacent to each other, and it is possible to decrease the width of the unit base 200 in the first direction X. The decrease in the width of the head unit 3 in the first direction X makes it possible to increase the stiffness of the unit base 200.

In addition, since the wall portion 230 provided in the unit base 200 makes it possible to increase the stiffness of the bottom portion 210, there is no need to increase the thickness of the bottom portion 210 and it is possible to less increase the weight of the unit base 200 such that it is possible to decrease the deformation due to the own weight and it is possible to decrease the size. Incidentally, in a case where the wall portion 230 is not provided in the unit base 200 and only the bottom portion 210 is provided, the thickness has to be increased in the third direction Z such that the stiffness of the bottom portion 210 is increased, then, the own weight is likely to be increased and the size is likely to be increased. In the embodiment, the wall portion 230 is provided in the unit base 200, and thereby it is possible to increase the stiffness of the unit base 200 and to decrease the weight and the size.

The unit base 200 is provided with a cable opening 201 into which the cable 126 of the recording head 100 is inserted. In the embodiment, the cable opening 201 is provided over a boundary between the bottom portion 210 and the wall portion 230. The cable 126 of the recording head 100, which is fixed to the unit base 200, is guided out to the supply surface 214 side via the cable opening 201.

In addition, a third wall portion 233 that projects outward, that is, in the first direction X, is provided on an end portion of the first wall portion 231 on the Z1 side. The third wall portion 233 is provided on the end portion of the first wall portion 231 on the Z1 side, and thereby a step 234 is formed on the outer side of the first wall portion 231. A relay substrate 400 is accommodated in the step 234 provided on the outer side of the first wall portion 231. Here, the relay substrate 400 is formed of a rigid substrate and is fixed in the step 234 by using a screw or the like. A plurality of cables 126 guided out through the cable opening 201 of the unit base 200 to the supply surface 214 side are connected to the relay substrate 400. As described above, the cables 126 of the plurality of the recording heads 100 are inserted into the cable openings 201, which open to the supply surface 214 of the unit base 200, and are connected to the common relay substrate 400, ink mists are difficult to infiltrate to the nozzle-formed surface 102 side through the cable openings 201, and it is possible to decrease an amount of inks attached to the cables 126, the wiring substrates 123 of the recording heads 100, or the like.

In addition, in the embodiment, the step 234 is provided by the third wall portion 233 on the outer side of the first wall portion 231 such that the relay substrate 400 is accommodated in the step 234. Therefore, the relay substrate 400 is less exposed on the Z1 side such that it is possible to decrease an amount of ink mists or the like attached to the relay substrate 400 from the nozzle-formed surface 102 side. In other words, the third wall portion 233 covers the Z1 side of the relay substrate 400, and thereby the inks are unlikely to be attached to the relay substrate 400.

Further, it is preferable that the relay substrate 400 have a size in the third direction Z which is larger than the height of the step 234 in the third direction Z. In this manner, a portion of the cable opening 201, which opens to the first wall portion 231, that is, an opening in the first direction X, is blocked with the relay substrate 400. Hence, the relay substrate 400 makes it possible to decrease an amount of the inks infiltrated through the cable openings 201. It is needless to say that the step 234, in which the relay substrate 400 is accommodated, is covered with a lid member or the like, and thereby it is possible to decrease the amount of the inks attached to the relay substrate 400.

As described above, the recording heads 100 are fixed to the unit base 200 via the spacers 300. Here, a head-side fixing surface of the recording head 100, which is fixed to the unit base 200 via the spacers 300, is positioned on the Z2 side opposite to the Z1 side on which the nozzle-formed surface 102 is provided. In this manner, it is possible to decrease the unit base 200 in size in the first direction X such that it is possible to increase the stiffness against torsion. Incidentally, in a case where the head-side fixing surface is provided on the nozzle-formed surface 102, there is a need to provide a flange or the like having the head-side fixing surface on the nozzle-formed surface 102 side, and there is a need to provide a region in the unit base 200 to which the flange is fixed. Then, the unit base 200 is likely to be increased in size. In particular, in the embodiment, since the plurality of recording heads 100 need to be provided to approach each other in the second direction Y, the region of the unit base 200, to which the flange is fixed, needs to be provided on both sides of the recording head 100 in the first direction X, then, the unit base 200 is likely to be increased in size in the first direction X and the stiffness thereof against the torsion is likely to be decreased.

In addition, in the embodiment, the recording heads 100 are fixed to the surface of the unit base 200 on the Z1 side, thereby it is possible to decrease the unit base 200 in size and it is possible to increase the stiffness of the unit base 200. Incidentally, in a case where the recording heads 100 are fixed on the surface of the unit base 200 on the Z2 side, there is a need to provide, in the unit base 200, openings for exposing the nozzle opening 101 side of the recording heads 100 on the Z1 side and approaching the nozzle openings 101 to the recording sheet S, a region for fixing the recording head 100, or the like, and thus the unit base is increased in size. In particular, in the embodiment, since the plurality of recording heads 100 need to be provided to approach each other in the second direction Y, the region of the unit base 200, to which the recording heads 100 are fixed, needs to be disposed on both sides of the recording head 100 in the first direction X, then, the unit base 200 is likely to be increased in size in the first direction X and the stiffness thereof against the torsion is likely to be decreased.

In addition, in the embodiment, the wall portion 230 is provided on the bottom portion 210 on the Z1 side on which the recording heads 100 are fixed, and thereby it is possible to decrease the head unit 3 in size in the third direction Z. Incidentally, the recording heads 100 may be provided on the unit base 200 on the Z1 side and the wall portion 230 may be provided on the unit base 200 on the Z2 side; however, the head unit 3 is increased in size in the third direction Z.

Further, in the embodiment, the wall portion 230 and the recording heads 100 are provided on the bottom portion 210 on the same Z1 side, and the wall portion 230 covers principal side surfaces of the recording heads 100. In this manner, it is possible to decrease an occurrence of a state in which the recording head 100 comes into contact with another member during work such as attaching the head unit 3 to the ink jet type recording apparatus 1, or the like. In addition, it is possible to decrease an occurrence of a case in which the recording sheet S comes into contact with the recording head 100 due to a paper jam or the like. Hence, it is possible to decrease an occurrence of a case where another member comes into contact with the recording head 100 such that it is possible to decrease damage to the recording head 100.

Note that it is preferable that the wall portion 230 be formed to have a size such that the wall portion covers interfaces of the members stacked to configure the recording head 100 in the third direction Z. In the embodiment, as illustrated in FIG. 3 or the like, the holding member 120 that configures the recording head 100 includes the flow-path member 121, the holder 122, and the wiring substrate 123 held between the flow-path member 121 and the holder 122. As illustrated in FIG. 7, the wiring substrate 123 is provided to be exposed on the stack interface between the flow-path member 121 and the holder 122. Therefore, the wall portion 230 covers the interface on which the wiring substrate 123 is exposed, that is, the stack interface between the flow-path member 121 and the holder 122, and thereby it is possible to decrease an amount of inks attached to the wiring substrate 123. The wiring substrate 123 may be provided not to be exposed on the interface formed between the flow-path member 121 and the holder 122 which are stacked. In other words, the interface between the members, which are stacked to configure the recording head 100, is not limited to the interface on which the wiring substrate 123 is exposed, but may be an interface on which adhesion is performed by using an adhesive or the like. The interface, on which the adhesion is performed by using the adhesive, is covered with the wall portion 230, thereby it is possible to decrease an occurrence of erosion of the adhesive by the ink such that it is possible to less decrease the strength of the adhesion. It is needless to say that the adhesive may not be provided on the interface between the members stacked to configure the recording head 100. The interface is covered with the wall portion 230 in any case, and thereby it is possible to decrease an amount of inks infiltrated in the recording head 100 from the interface. Incidentally, in the embodiment, the wall portion 230 is provided to have a size so as to approach the nozzle-formed surface 102. However, since the nozzle-formed surface 102 needs to be wiped with a wiper and to have a small distance to the recording sheet S, that is, a so-called paper gap, it is preferable that the nozzle-formed surface 102 side of the recording head 100 more project to the Z1 side than the wall portion 230.

In addition, the plurality of recording heads 100 are held in the unit base 200, and thereby it is possible to increase the yield ratio, compared to a case where a plurality of nozzle arrays are provided in the recording head 100 and multiple arrays are formed. However, the plurality of recording heads 100 are held in the unit base 200, and thereby the weight of all of the plurality of recording heads 100 is likely to be increased; however, the wall portion 230 is provided on the unit base 200, and thereby the stiffness of the unit base is increased such that it is possible to decrease the deformation due to the weight of the recording heads 100.

Note that, since the unit base 200 of the embodiment holds the plurality of recording heads 100 which are aligned in the second direction Y, the bottom portion 210 is short in the first direction X, is long in the second direction Y, and has a substantially rectangular shape. In this respect, the second wall portion 232 of the wall portion 230 is provided in the fourth direction Xa which is inclined with respect to the first direction X. Therefore, the bottom portion 210 has a first overhang 217 and a second overhang 218 that overhang outward from both end portions in the second direction Y, respectively, more than the wall portion 230, so as to have an eave shape. In other words, the bottom portion 210 has the first overhang 217 that more overhangs outward than the second wall portion 232 on the Y1 side of the second direction Y, and the second overhang 218 that more overhangs outward than the second wall portion 232 on the Y2 side of the second direction Y.

The first overhang 217 is provided with a first through-hole 219 that penetrates therethrough in the third direction Z. A first shaft 9*a* having the axial direction thereof in the third direction Z is inserted into the first through-hole 219. In addition, a first bearing 220 is provided in the first through-hole 219, so as to be in contact with an outer circumferential surface of the first shaft 9*a* and to receive the load of the shaft.

In addition, the second overhang 218 is provided with a cylindrical portion 221 that projects to the supply surface 214 side and more toward the Z2 side. A second through-hole 222, which penetrates through the cylindrical portion 221 and the second overhang 218 in the third direction Z, is provided inside the cylindrical portion 221, and a second shaft 9*b* having the axial direction thereof in the third direction Z is inserted into the second through-hole 222. In addition, a second bearing 223 and a third bearing 224 are provided in an opening of the second through-hole 222 on the Z1 side and an opening thereof on the Z2 side, respectively, so as to be in contact with an outer circumferential surface of the second shaft 9*b* and to receive the load of the shaft. In other words, the second bearing 223 is provided in the opening of the second through-hole 222 on the Z2 side and the third bearing 224 is provided in the opening thereof on the Z1 side. In addition, the second bearing 223 and the third bearing 224 are separately provided in the second through-hole 222. In the second through-hole 222, the load of the second shaft 9*b* is received at two positions of the two second bearing 223 and third bearing 224 provided at positions separated in the third direction Z. In other words, in the embodiment, the unit base 200 is supported by the two first and second shafts 9*a* and 9*b* provided in the apparatus main body 2, at total three positions of the first bearing 220, the second bearing 223, and the third bearing 224.

Further, the first overhang 217 is provided with a first contact portion 226 having the first contact surface 225 on the Z1 side. The first contact portion 226 has an extending portion 226*b* provided to project from the first overhang 217 toward Z2, and a first eave portion 226*a* that projects to have an eave shape from a projecting end portion of the extending portion 226*b* on the Z2 side toward the X1 side. A surface of the first eave portion 226*a* on the Z1 side is the first contact surface 225. In other words, the first contact portion 226 is provided with the first eave portion 226*a* on the end portion of the extending portion 226*b* on the Z2 side, and thereby it is possible to dispose the first contact surface 225 at a position more separated from the nozzle-formed surface 102 of the head unit 3 on the Z2 side.

In addition, the first contact portion 226 is provided with a first rib 226*c* and a second rib 226*d* that reinforce the fixing to the bottom portion 210. The first rib 226*c* and the second rib 226*d* are formed of a plate-like member connected to a surface of the extending portion 226*b* on the X2 side and to the supply surface 214 of the bottom portion 210. The first contact portion 226 is reinforced with the first rib 226*c* and the second rib 226*d*.

The first contact portion 226 is integrally formed with the unit base 200. The first contact portion 226 is integrally formed with the unit base 200, and thereby the stiffness of the first contact portion 226, particularly, the stiffness of the first eave portion 226*a*, is increased.

The second overhang 218 is provided with a second contact portion 228 having the second contact surface 227 on the Z1 side. The second contact portion 228 is provided with a second eave portion 228*a* provided to be continuous from an outer circumference of the cylindrical portion 221 at a position separated from the supply surface 214 on the Z2 side and to project to have an eave shape toward the X1 side. Incidentally, the cylindrical portion 221 is provided to more project than the second eave portion 228*a* on the Z2 side. A surface of the second eave portion 228*a* on the Z1 side is the second contact surface 227.

In addition, the second contact portion 228 has a reinforcement portion 228*b* provided between the second eave portion 228*a*, the outer circumferential surface of the cylindrical portion 221, and the supply surface 214 of the bottom portion 210. The second eave portion 228*a* is reinforced by the reinforcement portion 228*b*.

In addition, in the embodiment, the second contact portion 228 and the cylindrical portion 221 are integrally formed with the unit base 200. The second contact portion 228 and the cylindrical portion 221 are integrally formed with the unit base 200, and thereby the stiffness of the second contact portion 228 and the cylindrical portion 221, particularly, the stiffness of the second eave portion 228*a*, is increased.

A lifting-lowering mechanism is caused to come into contact with both of the first contact surface 225 of the first contact portion 226 and the second contact surface 227 of the second contact portion 228, such that the lifting-lowering mechanism presses the first contact surface 225 and the second contact surface 227 in the third direction X, and thereby it is possible to lift and lower the head unit 3 along the first shaft 9*a* and the second shaft 9*b* in the third direction Z.

Figure 11:
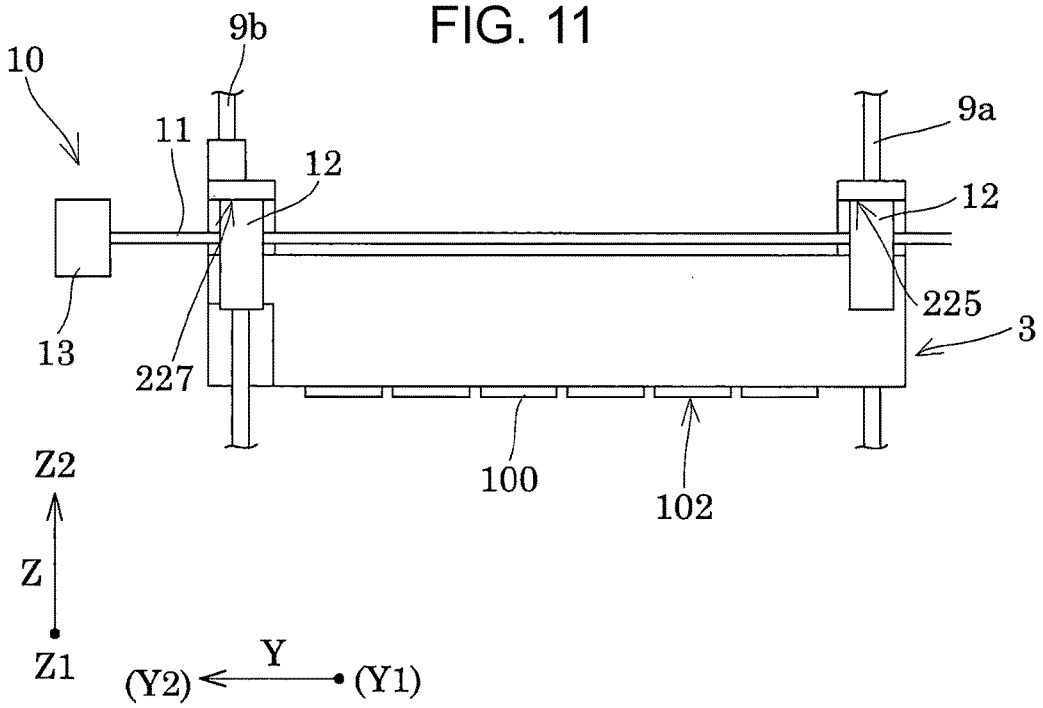
FIG. 11 is a front view illustrating the head unit and a lifting-lowering mechanism according to Embodiment 1 of the invention.
Figure 12:
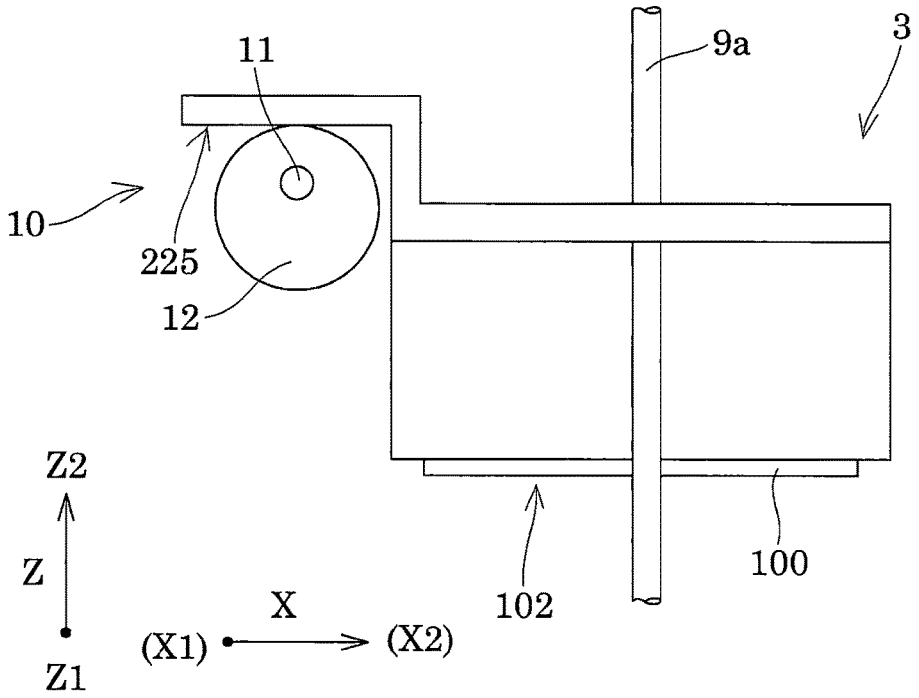
FIG. 12 is a side view illustrating the head unit and the lifting-lowering mechanism according to Embodiment 1 of the invention.
Figure 13:
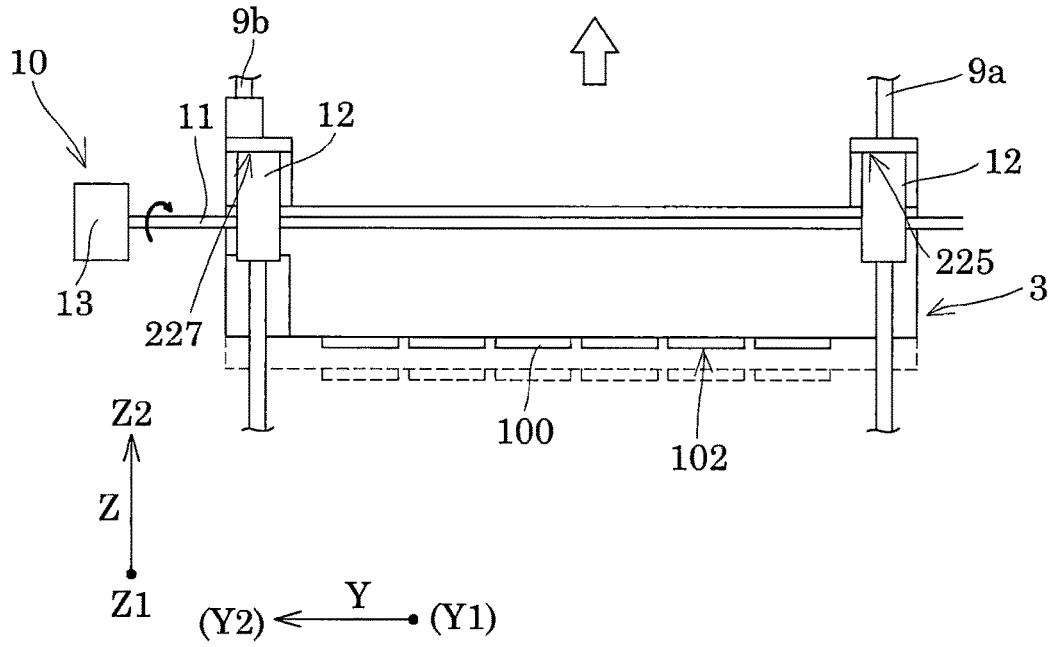
FIG. 13 is a front view illustrating the head unit and the lifting-lowering mechanism according to Embodiment 1 of the invention.
Figure 14:
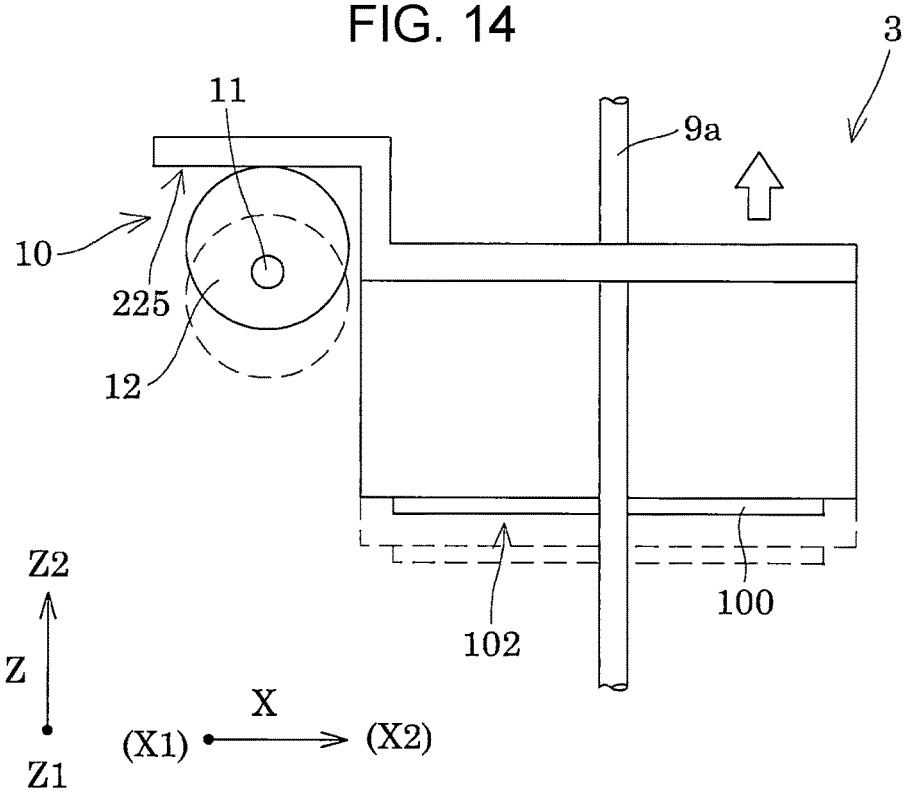
FIG. 14 is a side view illustrating the head unit and the lifting-lowering mechanism according to Embodiment 1 of the invention.

Here, a lifting-lowering mechanism 10 of the embodiment is further described with reference to FIGS. 11 to 14. FIGS. 11 and 13 are front views of the ink jet type recording apparatus to which the lifting-lowering mechanism is applied. FIGS. 12 and 14 are side views of the ink jet type recording apparatus to which the lifting-lowering mechanism is applied.

As illustrated in FIGS. 11 to 14, the lifting-lowering mechanism 10 includes a rotary shaft 11, which is rotatably held in the apparatus main body 2, two eccentric cams 12 fixed to the rotary shaft 11, and a drive unit 13 such as a motor which drives and rotates the rotary shaft 11 around the axial direction.

The eccentric cams 12 are disposed on the first contact surface 225 and the second contact surface 227 on the Z1 side, respectively, and the first contact surface 225 and the second contact surface 227 are in contact with the two eccentric cams 12 in the third direction Z due to the own weight of the head unit 3. The rotary shaft 11 is caused to rotate by the drive unit 13 from a state illustrated in FIGS. 11 and 12, and thereby the two eccentric cams 12 press the first contact surface 225 and the second contact surface 227, respectively, on the Z2 side as illustrated in FIGS. 13 and 14. In this manner, it is possible to cause the head unit 3 to move to the Z2 side. In addition, it is possible to cause the eccentric cams 12 to rotate from a position on the Z2 side illustrated in FIGS. 13 and 14, and thereby it is possible to cause the head unit 3 to move to the Z1 side illustrated in FIGS. 11 and 12.

As described above, the first contact surface 225 and the second contact surface 227 of the head unit 3, which project to the X1 side of the first direction X, are caused to come into contact with the eccentric cams 12 of the lifting-lowering mechanism 10, and the head unit 3 is supported by the three portions of the first bearing 220, the second bearing 223, and the third bearing 224 with respect to the two first and second shafts 9*a* and 9*b* even in a case where the head unit 3 can be lifted and lowered in the third direction Z. Therefore, it is possible to decrease the tilt of the head unit 3 in the first direction X with respect to the two first and second shafts 9*a* and 9*b*. In other words, the first contact surface 225 and the second contact surface 227 are provided to project to the X1 side. Therefore, when the lifting-lowering mechanism 10 comes into contact with the head unit 3 on the X1 side, the X1 side of the head unit 3 becomes higher to the Z2 direction, and the head unit is likely to have a tilt in a rotating direction to the first direction X in which the X2 side thereof becomes lower to the Z1 direction. In particular, in a case where only two bearings are provided to support the head unit 3 with respect to the two first and second shafts 9*a* and 9*b*, the head unit has a remarkable tilt. In the embodiment, the two second and third bearings 223 and 224 are provided to the single second shaft 9*b*, and thereby it is possible to decrease the head unit 3 in size in the first direction X. In addition, the two second and third bearings 223 and 224 are provided to the second shaft 9*b*, and thereby it is possible to decrease the tilt to the rotating direction to the second direction Y.

Incidentally, a configuration, in which a total of four bearings are provided to the two first and second shafts 9*a* and 9*b*, with two bearings for each shaft, is considered; however, it is difficult to adjust positions of the four bearings, respectively, and a clearance, a tilt, or the like of the first shaft 9*a* and the second shaft 9*b*, and thus a bias in the clearance of the bearings with the first shaft 9*a* and the second shaft 9*b* occurs and the head unit 3 is difficult to move in the third direction Z. In the embodiment, the three bearings of the first bearing 220, the second bearing 223, and the third bearing 224 are provided with respect to the two shafts of the first shaft 9*a* and the second shaft 9*b*, and thereby it is possible to easily adjust the clearances between the shaft and the bearing such that it is possible to cause the head unit 3 to smoothly move with respect to the first shaft 9*a* and the second shaft 9*b* in the third direction Z.

In addition, in embodiment, the wall portion 230 is provided on the unit base 200 and thereby the unit base 200 is increased in stiffness. Hence, even in a case where the two first and second shafts 9*a* and 9*b* support both end portions of the unit base 200 in the first direction X, it is possible to decrease the deformation of the unit base 200, particularly, the deformation in the second direction Y or the deformation in a torsional direction.

Further, in the embodiment, the first contact surface 225 and the second contact surface 227, with which the lifting-lowering mechanism 10 comes into contact, are disposed at positions which are separated from the nozzle-formed surface 102 on the Z2 side. In other words, the first contact surface 225 is disposed on the Z2 side from the supply surface 214 by the extending portion 226*b* and the second contact surface 227 is provided to be continuous from the outer circumferential surface of the cylindrical portion 221, and thus the second contact surface is disposed on the Z2 side from the supply surface 214. Therefore, it is possible to dispose the pressing rollers 607 at positions which are closer to the nozzle-formed surface 102 on the X1 side and the X2 side of the first direction X. Hence, it is possible to decrease a space between the two pressing rollers 607 in the first direction X, and thus it is easy to fix the posture of the recording sheet S between the two pressing rollers 607 such that it is possible to improve print quality. In addition, it is possible to dispose a suction device that suctions the ink mists, or the like, on the nozzle-formed surface 102 on the X1 side or the like, although not specifically illustrated. Hence, it is possible to efficiently suction and to remove the mists in the vicinity of the nozzle-formed surface 102 by the suction device, and it is possible to improve the print quality.

In addition, in the head unit 3, a cap comes into contact with the nozzle-formed surface 102 on the Z1 side. At this time, when the head unit 3 comes into contact with the eccentric cam 12 due to only the own weight, there is a concern that the head unit 3 will float to the Z2 side due to the contact with the cap. Therefore, when the cap comes into contact with the head unit, the cap comes into contact with the supply surface 214 side of the head unit 3. It is preferable that a floating preventive unit be provided to prevent the head unit 3 from floating to the Z2 side.

Figure 15:
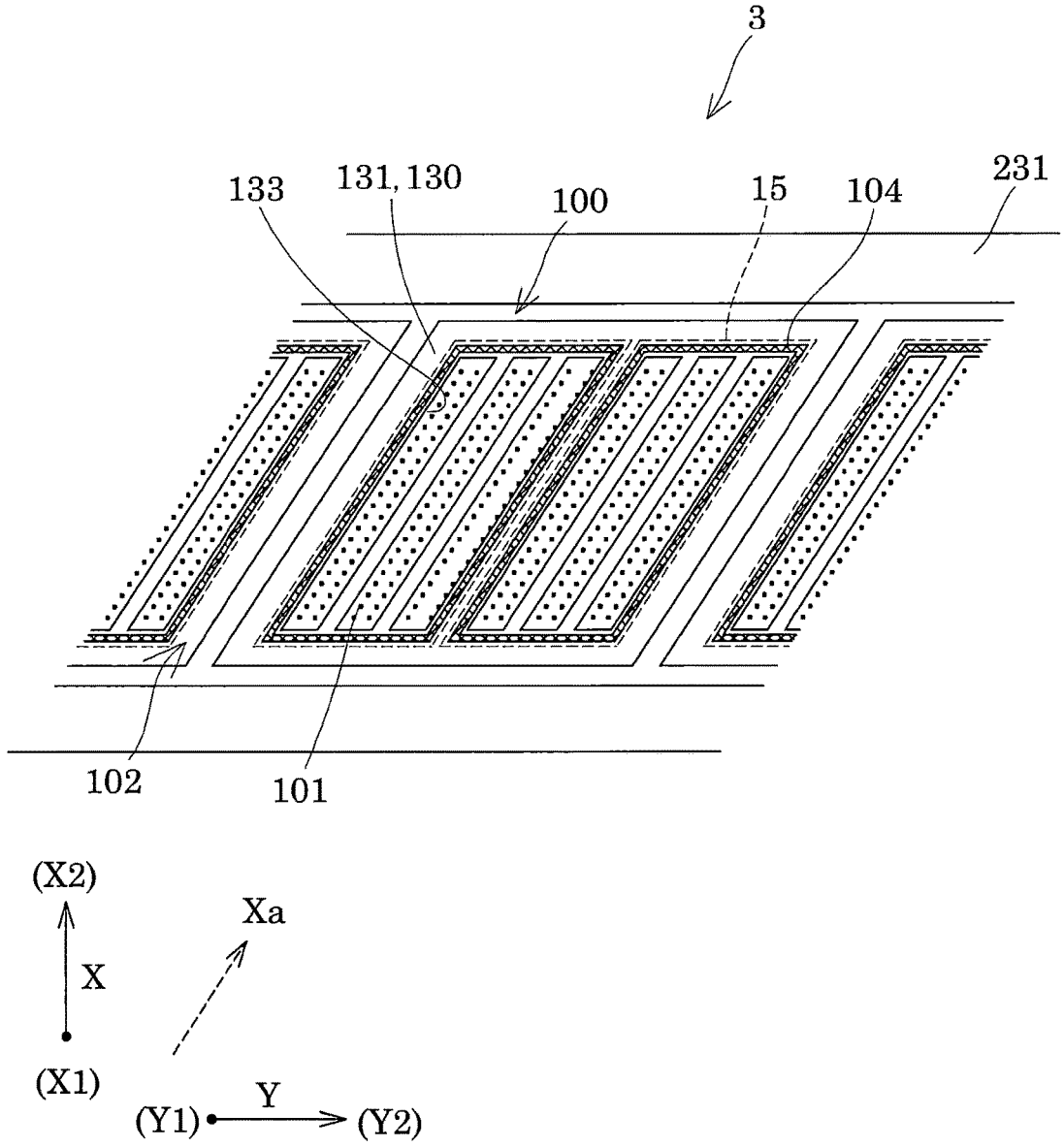
FIG. 15 is an underside view illustrating a main part of the head unit according to Embodiment 1 of the invention.

Here, the cap is described with reference to FIG. 15. FIG. 15 is an underside view illustrating a main part of the head unit. As illustrated in FIG. 15, the cap 15 comes into contact with the nozzle-formed surface 102 of the head unit 3, and, in the embodiment, the cap has a size so as to cover some nozzle openings 101 of the single recording head 100 fixed to the head unit 3. Specifically, a plurality of, in the embodiment, six head main bodies 110 are held in the single recording head 100, and the cap 15 has a size to cover the nozzle openings 101 of three head main bodies 110 of the six head main bodies 110. As described above, one cap 15 has the size to cover some nozzle openings 101 of the one recording head 100, and thereby a load obtained when the cap 15 comes into contact with the nozzle-formed surface 102 is increased such that it is possible to increase the sealing performance. The sealing performance between the cap 15 and the nozzle-formed surface 102 is improved, and thereby it is possible to suction the inside of the cap 15 such that it is possible to normally perform a suction operation of suctioning the ink from the nozzle openings 101. In addition, the sealing performance between the cap 15 and the nozzle-formed surface 102 is improved, and thereby it is possible to decrease an amount of inks evaporating from the nozzle openings 101. Note that it is preferable that the fixing surface 213, on which the recording heads 100 are fixed to the unit base 200, be disposed at a position overlapped with a seal portion 104 of the nozzle-formed surface 102 with which the cap 15 comes into contact with, in a plan view of the nozzle-formed surface 102. In this manner, even when the cap 15 comes into contact with the nozzle-formed surface 102 due to a high load, the fixing surface 213 of the unit base 200 can receive the load of the cap 15, and it is possible to decrease the deformation or the positional shift of the recording head 100 due to the load of the cap 15. Incidentally, when the fixing surface 213 is provided at a position which is not overlapped with the seal portion 104 of the cap 15, the shear stress is applied to the recording head 100 due to the load of the cap 15 and the deformation or the positional shift is likely to be produced.

Note that, in the embodiment, one cap 15 has a size to cover some nozzle openings 101 of one recording head 100; however, the configuration is not limited thereto, and one cap 15 may have a size to cover all of the nozzle openings 101 of the recording head 100, or one cap 15 may have a size to cover the nozzle openings 101 of the plurality of recording heads 100. However, as an area which is covered with the cap 15 is more increased, it is difficult to increase the load to the nozzle-formed surface 102.

Figure 16:
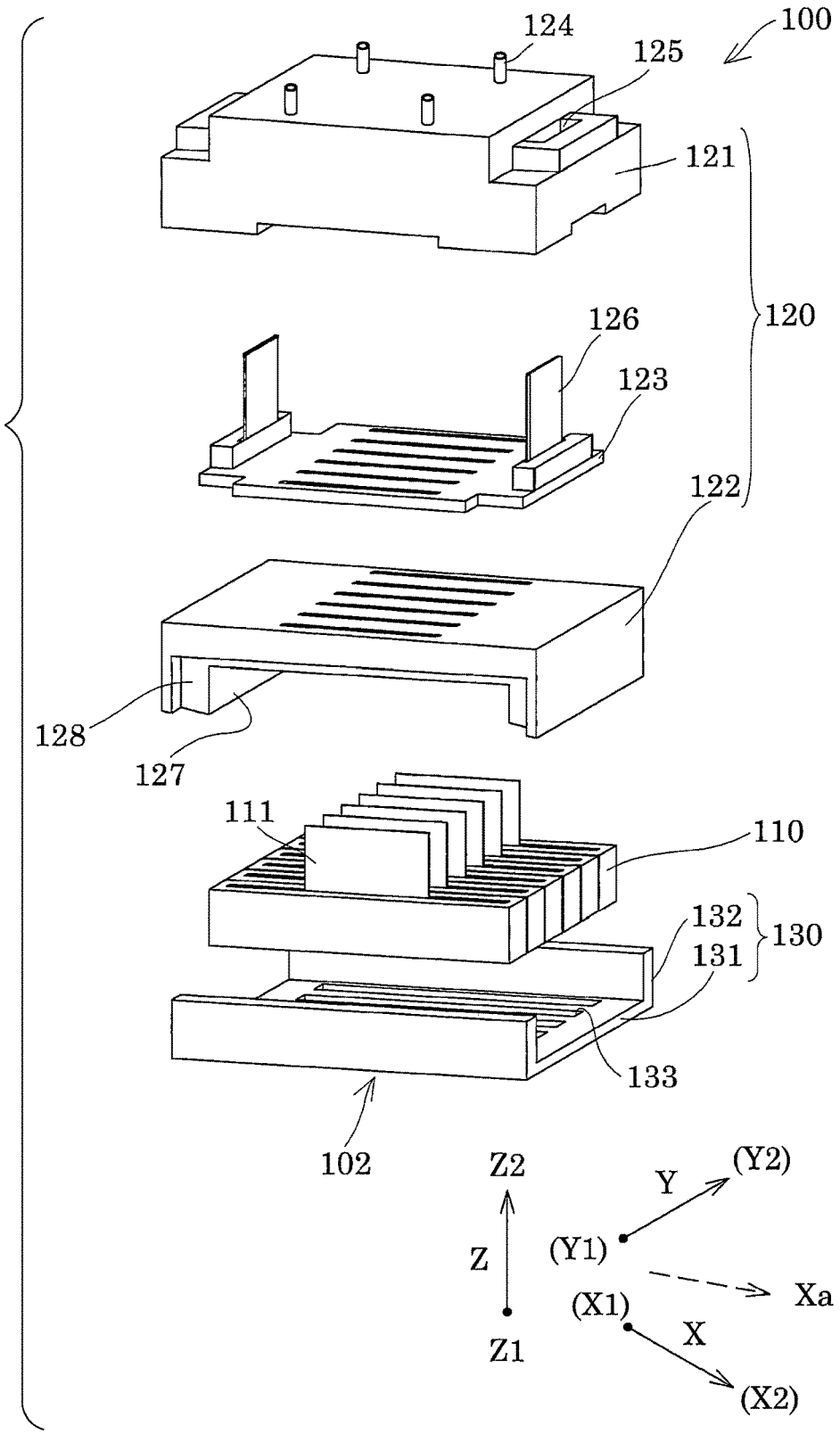
FIG. 16 is an exploded perspective view illustrating a recording head according to Embodiment 1 of the invention.

Here, an example of the recording head 100, which is fixed to the unit base 200, is more described with reference to FIG. 16. FIG. 16 is an exploded perspective view illustrating the ink jet type recording head according to Embodiment 1 of the invention. In addition, in the embodiment, the directions of the recording head 100 are described, based on directions obtained when the recording head is mounted in the ink jet type recording apparatus 1, that is, the first direction X, the second direction Y, and the third direction Z.

As illustrated in FIGS. 3, 5, 7, and 16, the recording head 100 is configured to include a plurality of members which are stacked in the third direction Z. Specifically, the recording head 100 includes the plurality of head main bodies 110 from which ink droplets are discharged, the holding members 120 that hold the plurality of head main bodies 110, and the covers 130 as fixing plates provided on the nozzle-formed surface side of the head main bodies 110.

The head main body 110 has nozzle openings 101 on the Z1 side in the third direction Z. A surface of the head main body 110 provided with the nozzle openings 101 on the Z1 side configures a part of the nozzle-formed surface 102. In addition, in the inside (not illustrated) of the head main body 110, a flow path that communicates with the nozzle opening 101, and a pressure generating unit that causes a change in the pressure of the ink in the flow path are provided. As the pressure generating unit, it is possible to use a pressure generating unit that changes a volume of the flow path due to deformation of a piezoelectric actuator having a piezoelectric material with an electromechanical converting function, that causes a change in the pressure in the ink in the flow path, and that discharges ink droplets from the nozzle openings 101, a pressure generating unit in which a heating element is disposed in the flow path, and ink droplets are caused to be discharged from the nozzle openings 101 due to bubbles produced by the heating of the heating element, or a so-called electrostatic actuator that generates an electrostatic force between a vibration plate and an electrode, in which the vibration plate is deformed due to the electrostatic force, and that discharges ink droplets from the nozzle openings 101, or the like.

In addition, drive wirings 111 connected to the pressure generating unit in the inside (not illustrated) are guided out from the surface of the head main body 110 on the Z2 side.

The Z2 side of the plurality of head main bodies 110 are fixed to a surface of the holding member 120 on the Z1 side.

In addition, the holding member 120 includes the flow-path member 121, the holder 122, and the wiring substrate 123 held between the flow-path member 121 and the holder 122.

In the inside (not illustrated) of the flow-path member 121, a flow path is provided to supply, to the head main body 110, inks supplied from the liquid storing unit 4. The flow path is provided to open to the front end surface of protrusions 124 which are provided on a surface of the flow-path member 121 on the Z1 side and protrude to the Z2 side in the third direction Z. In the embodiment, four protrusions 124 are provided on the surface of the flow-path member 121 on the Z1 side. In other words, four separate flow paths are provided in the inside of the flow-path member 121. Note that a filter for removing foreign substances such as dirt or bubbles contained in the inks may be provided in the flow path of the flow-path member 121.

The holder 122 is fixed to a surface of the flow-path member 121 on the Z1 side, and in the inside (not illustrated) of the holder, flow paths that communicate with the flow paths provided in the inside of the flow-path member 121 are provided. The inks supplied from the flow-path member 121 are supplied to the plurality of head main bodies 110 via the flow paths in the holder 122. Note that each path provided in the inside of the holder 122 diverges into a plurality of paths through which the inks are supplied to the plurality of head main bodies 110, although not specifically illustrated.

The flow-path member 121 and the holder 122 are stacked in the third direction Z and are fixed by using third screw members 403 (refer to FIG. 6). In other words, an interface exists between the flow-path member 121 and the holder 122. In addition, the wiring substrate 123 is held on the interface, that is, between the flow-path member 121 and the holder 122. The wiring substrate 123 is formed of a rigid substrate which is common to the drive wirings 111 of the plurality of head main bodies 110 and to which the drive wirings are electrically connected. In addition, in the embodiment, the wiring substrate 123 is provided to be exposed on the side surface of the recording head 100, that is, from the stack interface between the flow-path member 121 and the holder 122.

In addition, cable inserting holes 125, which penetrate through the flow-path member 121 in the third direction Z, are provided in both end portions of the flow-path member 121 in the first direction X. The cables 126 inserted into the cable inserting holes 125 from the Z1 side of the flow-path member 121 are connected to the wiring substrate 123 held between the flow-path member 121 and the holder 122.

In addition, the holder 122 includes a holding portion 127 that forms a groove-shaped space on the Z1 side. The holding portion 127 is provided to be continuous to the surface of the holder 122 on the Z1 side in the second direction Y, and thereby the holding portion is provided to open to both sides thereof in the second direction Y. In addition, the holder 122 is provided with the holding portion 127 substantially at the central portion in the first direction X, and leg portions 128 are formed on both sides of the holding portion 127 in the first direction X. In other words, the leg portions 128 are provided on both end portions only in the first direction X of the surface of the holder 122 on the Z1 side and are not provided on both end portions in the second direction Y.

The plurality of head main bodies 110 are fixed in the holding portion 127. In other words, the leg portions 128 are positioned on both sides in the first direction X with respect to the head main body 110. In addition, the holder 122 and the head main body 110 have surfaces facing each other in the third direction Z and adhering to each other. In the embodiment, six head main bodies 110 adhere to the single holder 122. It is needless to say that the number of head main bodies 110 which are fixed to the single holder 122 is not limited to the holder described above, and a single head main body 110 may be fixed to the single holder 122, or two or more head main bodies may be fixed to the single holder. Incidentally, the plurality of head main bodies 110 are provided to the single recording head 100 and multiple nozzle arrays are formed, and thereby it is possible to increase the yield ratio, compared to a case where a plurality of nozzle arrays are provided in only one head main body 110 with respect to the single recording head 100 and multiple arrays are formed. In addition, the plurality of head main bodies 110 are provided in the single recording head 100, thereby it is easy to increase the weight of the recording head 100; however, the wall portion 230 is provided on the unit base 200 and the stiffness of the unit base is increased, and thereby it is possible to decrease the deformation of the unit base 200 due to the weight of the recording heads 100.

Note that the plurality of head main bodies 110 of the embodiment are fixed to have nozzle arrays which are inclined with respect to the first direction X as the transport direction of the recording sheet S, in the in-plane direction of the nozzle-formed surface 102. In other words, the fourth direction Xa as the alignment direction of the nozzle openings 101 that form the nozzle array means a direction inclined with respect to the first direction X. In the embodiment, the recording head 100 is configured to include the plurality of head main bodies 110 which are aligned in the second direction Y, and thus it is possible to dispose the head main bodies 110 at positions at which at least some nozzle openings 101 of the head main bodies 110, which are adjacent to each other in the second direction Y, overlap each other in the first direction X. In addition, as described above, the plurality of recording heads 100 are aligned in the second direction Y, and thus it is possible to dispose the recording heads 100 at positions at which at least some nozzle openings 101 of the recording heads 100, which are adjacent to each other in the second direction Y, overlap each other in the first direction X. Accordingly, it is possible to form the nozzle openings 101, which are aligned in the head unit 3 at equal intervals in the second direction Y.

The cover 130 covers the opening of the holding portion 127 of the holder 122 on the Z1 side. In the embodiment, a surface of the cover 130 on the Z1 side and a surface of the head main body 110 on the Z1 side exposed by an exposure opening 133 are referred to as a nozzle-formed surface 102.

In addition, right-angle bending portions 132 are provided on both end portions of a base portion 131 in the second direction Y, and are formed to have a size to cover an opening area of the holding portion 127 that opens to the sides in the second direction Y. The right-angle bending portions 132 adhere to side surfaces of the holder 122 in the second direction Y. In this manner, the openings of the holding portion 127 to the sides in the second direction Y are covered and sealed by the right-angle bending portion 132.

As described above, in the embodiment, since the right-angle bending portions 132 are provided on the cover 130 on both sides of the holder 122 in the second direction Y, and thereby the cover 130 and the holder 122 adhere to each other, there is no need to provide leg portions for adhering to the base portion 131 of the cover 130 on both sides of the holder 122 in the second direction Y. Therefore, since there is no leg portion between the adjacent recording heads 100 when the recording heads 100 are aligned in the second direction Y, it is possible to decrease a gap between the recording heads 100 which are adjacent to each other in the second direction Y. In this manner, the head main bodies 110 of the recording heads 100, which are adjacent to each other in the second direction Y, can be provided to approach each other, and the nozzle openings 101 provided in the head main bodies 110 of the adjacent recording heads can be provided to approach each other in the second direction Y.

Note that the configuration is not limited thereto, and the recording head 100 may be provided with the leg portions on both sides of the holder 122 in the second direction Y. In addition, the right-angle bending portion 132 may be provided on the entire circumference of the cover 130 without the leg portions, and the right-angle bending portion 132 may cover the entire side surfaces of the head main body 110.

As described above, the plurality of, in the embodiment, six recording heads 100 are aligned in the second direction Y, that is, are aligned in a straight line and are detachably fixed to the unit base 200. In other words, the plurality of recording heads 100 are not disposed to be shifted from one another in the first direction X. In this manner, it is possible to decrease the width of the head unit 3 in the first direction X, and thus it is possible to decrease the head unit 3 in size. It is needless to say that the recording heads 100 aligned in the second direction Y may be arranged to be shifted in the first direction X; however, when the recording heads 100 are significantly shifted in the first direction X, the width of the unit base 200 or the like in the first direction X is likely to be widened. As described above, when the head unit 3 is increased in size in the first direction X, the distance between the two pressing rollers 607 becomes long in the first direction X in the ink jet type recording apparatus 1, and it is difficult to fix the posture of the recording sheet S. In addition, the head unit 3 and the ink jet type recording apparatus 1 are likely to be increased in size.

Embodiment 2

Figure 17:
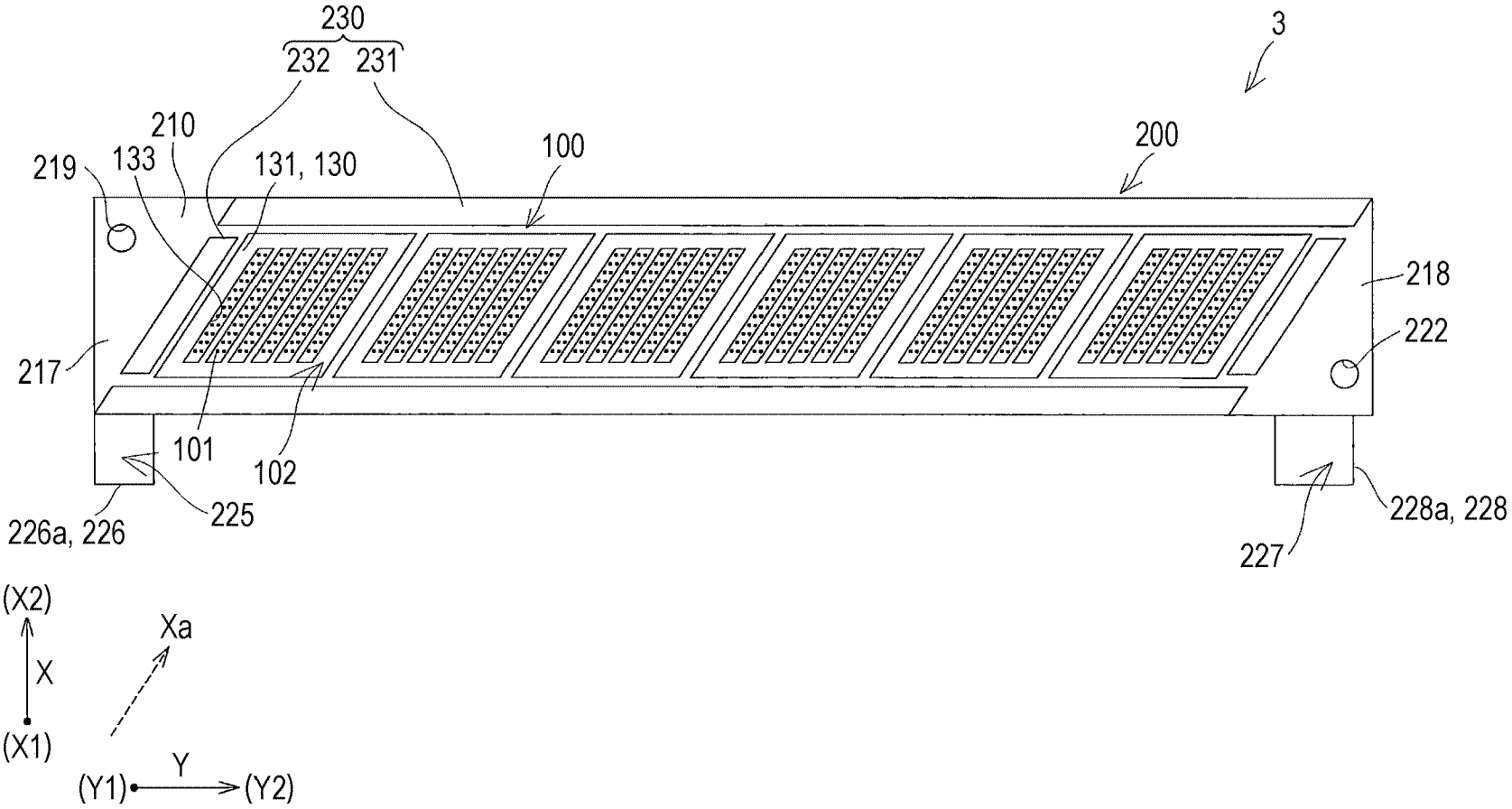
FIG. 17 is an underside view illustrating a head unit according to Embodiment 2 of the invention.

FIG. 17 is an underside view illustrating a liquid ejecting head unit according to Embodiment 2 of the invention. Note that the same reference signs are assigned to the same members as those in Embodiment 1 described above, and detailed description thereof is omitted.

As illustrated in FIG. 17, the unit base 200 includes the bottom portion 210 and the wall portion 230.

The wall portion 230 includes two first wall portions 231 provided to be continuous in the second direction Y, and two second wall portions 232 provided to be continuous in the fourth direction Xa. The first wall portions 231 and the second wall portions 232 are disposed to have a gap therebetween such that the end portions thereof are disconnected from each other.

Also in this configuration, similar to Embodiment 1 described above, it is possible to increase the stiffness of the unit base 200 in the second direction Y with the first wall portions 231 and it is possible to increase the stiffness of the unit base 200 in the first direction X with the second wall portions 232. In addition, it is possible to increase the stiffness of the unit base in the torsional direction with the first wall portion 231 and the second wall portion 232. However, when the first wall portion 231 and the second wall portion 232 are provided to be continuous with each other at the end portions as in Embodiment 1, it is possible to more increase the stiffness of the unit base 200, compared to a case where the end portions are disconnected from each other.

Note that, in the embodiment, the first wall portions 231 and the second wall portions 232 are disconnected at the end portions; however, the configuration is not particularly limited thereto, and any position of the first wall portion 231 and any position of the second wall portion 232 may be disconnected. In other words, a plurality of the first wall portions 231 may be provided in the second direction Y. In this case, the first wall portions 231 that are adjacent in the second direction Y may be disposed to overlap each other in the first direction X. However, when the first wall portions 231 overlap each other in the first direction X, there is a concern that there is a need to have an extra space in a region in which the first wall portions 231 are provided. In Embodiments 1 and 2 described above, the first wall portion 231 is provided to be continuous in the second direction Y, and thereby it is possible to decrease the size, compared to a case where the plurality of first wall portions 231 are arranged in the second direction Y. The same is true of the second wall portion 232.

Other Embodiments

As described above, the embodiments of the invention are described; however the basic configurations of the invention is not limited to the embodiments described above.

In Embodiments 1 and 2 described above, the second wall portions 232 are provided as the wall portions 230; however, the configuration is not particularly limited thereto, and only the first wall portions 231 may be provided as the wall portions 230. Even when only the first wall portions 231 are provided, it is possible to increase the stiffness of the head unit 3 in the second direction Y as the longitudinal direction, and it is possible to increase the stiffness in the torsional direction. In addition, the configuration of having the two first wall portions 231 is described as an example; however, the number of the first wall portions 231 is not limited to two, and one first wall portion or three or more first wall portions may be provided. It is needless to say that the same is true of the second wall portion 232.

In addition, in Embodiments 1 and 2 described above, the wall portion 230 of the unit base 200 is provided on the surface side on which the recording heads 100 are held, that is, on the Z1 side; however, the configuration is not particularly limited thereto, and the wall portion 230 may be provided on the Z2 side of the bottom portion 210. However, as Embodiments 1 and 2 described above, when the wall portion 230 is provided on the Z1 side of the bottom portion 210, it is possible to decrease the head unit 3 in size, and it is possible to protect the side surface of the recording head 100 by the wall portion 230 such that it is possible to decrease damage caused when the recording heads 100 come into contact with the recording sheet S. In addition, the side surfaces of the recording heads 100 are protected by the wall portion 230, and thereby it is possible to decrease an amount of inks which are attached to the stack interface of the recording head 100. Note that the wall portion 230 may be provided on both sides of the Z1 side and the Z2 side of the bottom portion 210. In this manner, it is possible to increase stiffness of the head unit 3. However, the wall portion 230 is provided on the Z2 side of the bottom portion 210, and thereby the head unit 3 is likely to be increased in size in the third direction Z.

Note that, in the embodiment, the plurality of recording heads 100 are screwed and fixed to the unit base 200 by using the spacers 300, the first screw member 401, and the second screw member 402; however, the configuration is not particularly limited thereto. For example, the plurality of recording heads 100 may adhere to the unit base 200 with an adhesive or may be fixed by using a clip or the like.

In addition, in Embodiments 1 and 2 described above, the alignment direction of the plurality of recording heads 100 held in the unit base 200 is the second direction Y as the direction perpendicular to the first direction X as the transport direction of the recording sheet S; however, the configuration is not particularly limited thereto, and a head unit, in which the recording heads 100 are aligned in the longitudinal direction of the unit base 200, may be disposed such that the plurality of recording heads 100 have an alignment direction at an angle intersecting with the first direction X as the transport direction of the recording sheet S, that is, at an angle which is smaller than 90 degrees with respect to the first direction X. At this time, it is possible to provide the nozzle array in a direction perpendicular to the longitudinal direction of the unit base 200 in the in-plane direction of the nozzle-formed surface 102, and the entire head unit is inclined, and thereby it is possible to dispose the nozzle array in a direction inclined with respected to the first direction X as the transport direction.

In addition, in Embodiments 1 and 2 described above, the recording heads 100 are arranged in a straight line in the second direction Y; however, the configuration is not particularly limited thereto, and the recording heads 100 may be arranged in a zigzag pattern in the second direction Y. Here, in the arrangement of the recording heads 100 in the zigzag pattern in the second direction Y, the recording heads 100 arranged in the second direction Y are disposed to be alternately shifted in the first direction X, and two rows of the recording heads 100 arranged in the second direction Y are arranged side by side in the first direction X. However, when the recording heads 100 as in Embodiments 1 and 2 described above are arranged in the straight line in the second direction Y, it is possible to decrease the head unit 3 in size in the first direction X, compared to the case of the arrangement in the zigzag pattern.

Figure 18:
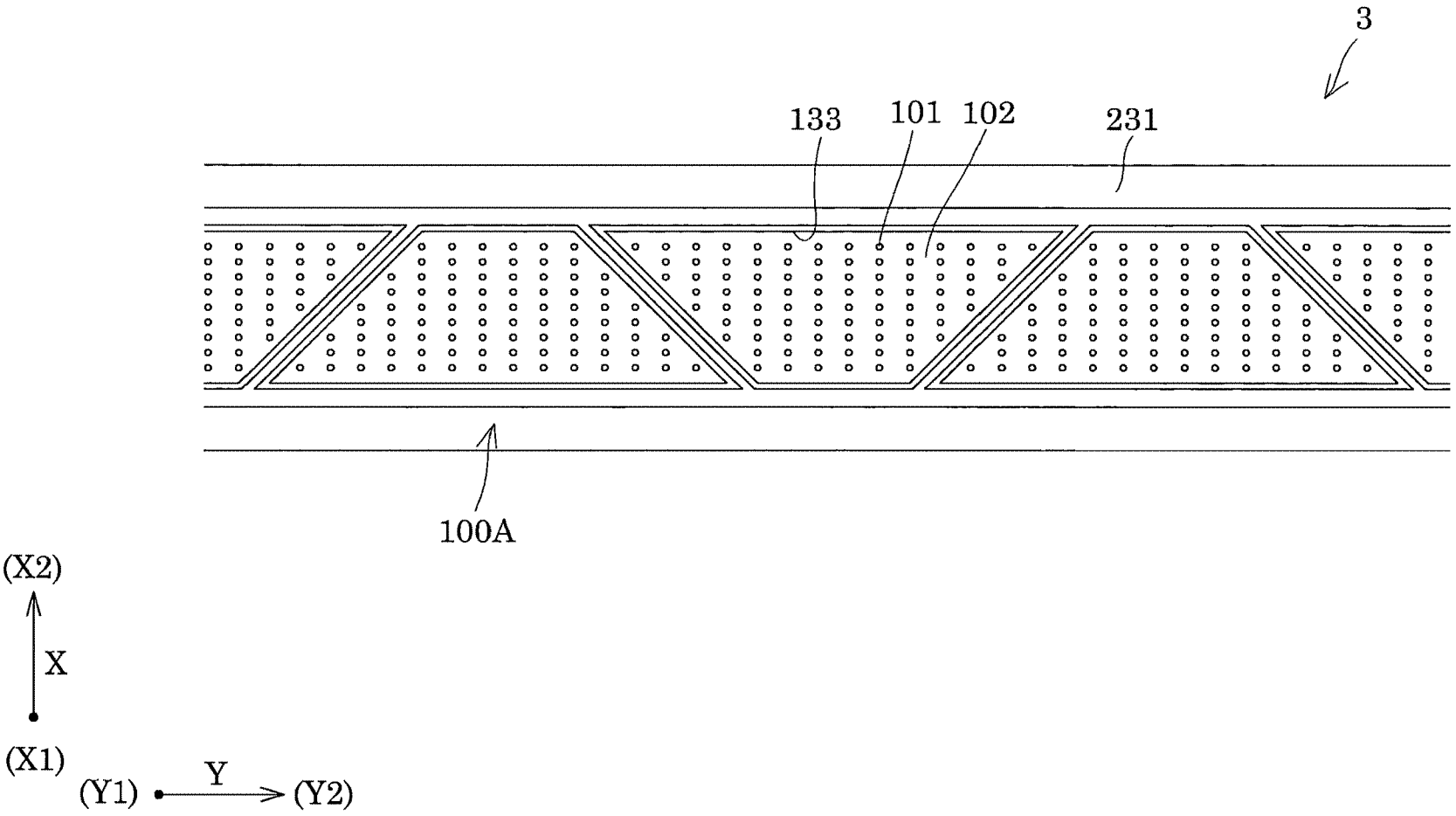
FIG. 18 is an underside view illustrating a head unit according to another embodiment of the invention.

Further, in the embodiments described above, the fourth direction Xa as the alignment direction of the nozzle openings 101 of the head main body 110 is the direction inclined with respect to the second direction Y orthogonal to the first direction X as the transport direction; however, the fourth direction Xa as the alignment direction of the nozzle openings 101 may be the same direction as the first direction X as the transport direction, or the fourth direction Xa as the alignment direction of the nozzle openings 101 may be the same direction as the second direction Y. Further, the nozzle openings 101 are not limited to the alignment in an array shape, and the nozzle openings 101 may be disposed to have a matrix shape. Further, in Embodiment 1 described above, the holder 122 has a substantially parallelogramic shape in a plan view kin the third direction Z perpendicular to the nozzle-formed surface 102; however, the configuration is not particularly limited thereto, and the holder may have a rectangular shape, a trapezoidal shape, a polygonal shape, or the like. Here, FIG. 18 illustrates an example described above. FIG. 18 is a plan view illustrating the recording head unit as an example of the liquid ejecting head unit according to another embodiment of the invention, when viewed from the liquid ejecting surface side.

As illustrated in FIG. 18, a recording head 100A has a trapezoidal shape in a plan view from the nozzle-formed surface 102 side. In addition, the plurality of recording heads 100A are aligned in the second direction Y and are fixed to the unit base 200, and the recording heads 100A aligned in the second direction Y are alternately inverted by 180 degrees in the in-plane direction of the nozzle-formed surface 102.

In the recording head 100A, the nozzle openings 101 are arranged in a matrix shape in the nozzle-formed surface 102. Also in this configuration, by using the same unit base 200 as those in the embodiments described above, it is possible to increase the stiffness of the head unit 3 such that it is possible to less decrease the print quality due to the deformation. Note that, also in the recording head 100 of the embodiments described above, the nozzle openings 101 may be arranged in the matrix shape.

In addition, in the embodiments described above, the eccentric cam 12 or the like is used as the lifting-lowering mechanism 10; however, the lifting-lowering mechanism that causes the head unit 3 to be lifted and lowered in the third direction Z is not particularly limited thereto. For example, a contact member that comes into contact with the first contact surface 225 and the second contact surface 227 may be caused to reciprocate in the third direction Z by hydraulic pressure or drive of a motor.

Further, in Embodiments 1 and 2 described above, as the ink jet type recording apparatus 1, a so-called line type recording apparatus, in which the head unit 3 is fixed to the apparatus main body 2, only the recording sheet S is transported, and thereby printing is performed, is exemplified; however, the apparatus is not particularly limited thereto, and the invention can be applied to a so-called serial type recording apparatus in which the head unit 3 is mounted on a carriage that moves in a direction intersecting with the first direction X as the transport direction of the recording sheet S, for example, in the second direction Y, and printing is performed while the head unit 3 moves in the direction intersecting with the transport direction. In addition, the configuration is not limited to the configuration in which the recording sheet S is transported with respect to the head unit 3, and printing may be performed by a configuration in which the head unit 3 is caused to move with respect to the recording sheet S, or the recording sheet S may be relatively move with respect to the head unit 3.

Note that, in the embodiments described above, the recording head unit as an example of the liquid ejecting head unit, or the ink jet type recording apparatus as an example of the liquid ejecting apparatus is described; however, the invention is widely applied to a liquid ejecting head unit and a liquid ejecting apparatus in general, as a target, and can be also applied to a liquid ejecting head unit or a liquid ejecting apparatus including a liquid ejecting head that ejects liquids in addition to an ink. Examples of other liquid ejecting heads include various recording heads that are used in an image recording apparatus such as a printer, a color material ejecting head that is used in manufacturing a color filter of a liquid crystal display or the like, an electrode material ejecting head that is used in forming electrodes of an organic EL display, a field emission display (FED), or the like, a bioorganic material ejecting head that is used in manufacturing a biochip, and the invention can be applied to a liquid ejecting head unit and a liquid ejecting apparatus including the liquid ejecting head.

What is claimed is:

1. A liquid ejecting head unit comprising:

a plurality of liquid ejecting heads that have a nozzle-forming surface; and a unit base that comprises a bottom portion having a fixing surface to which the plurality of liquid ejecting heads are fixed, and a wall portion that extends from the bottom portion in a direction perpendicular to the fixing surface and that is continuous in a direction in which the plurality of liquid ejecting heads are aligned, wherein the plurality of liquid ejecting heads each include a plurality of head main bodies that have nozzle openings through which ink is ejected, wherein the bottom portion of the unit base has a thick portion thicker than a fixing portion provided with the fixing surface and is continuous in an alignment direction of the liquid ejecting heads.

2. The liquid ejecting head unit according to claim 1, wherein the plurality of liquid ejecting heads are arranged in a row.

3. A liquid ejecting apparatus comprising:

the liquid ejecting head unit according to claim 2.

4. The liquid ejecting head unit according to claim 1, wherein the wall portion has a ring shape that continuously surrounds the plurality of liquid ejecting heads.

5. The liquid ejecting head unit according to claim 1, wherein the liquid ejecting head has a head-side fixing surface which is fixed to the fixing surface of the unit base, and is positioned on a side opposite to the nozzle-forming surface.

6. The liquid ejecting head unit according to claim 1, wherein the liquid ejecting head is fixed to a plurality of positions of the unit base in a short direction thereof.

7. The liquid ejecting head unit according to claim 6, wherein the liquid ejecting head has fixing positions in both ends in the short direction, of a plurality of fixing positions thereof, which are disposed in regions of both ends in a case where the bottom portion is divided into four regions in the short direction.

8. The liquid ejecting head unit according to claim 1, wherein the thick portion is provided with a supply hole through which a supply flow that supplies liquids to the liquid ejecting head penetrates.

9. The liquid ejecting head unit according to claim 1, wherein, in a case where the nozzle-forming surface is viewed in a plan view, the fixing surface is disposed at a position which is overlapped with a seal portion of a cap with respect to the nozzle-forming surface.

10. The liquid ejecting head unit according to claim 1, wherein the liquid ejecting head is configured to include stacked members and the wall portion covers an interface of the stacked members.

11. The liquid ejecting head unit according to claim 1, wherein the bottom portion is provided with a cable opening through which a cable connected to the liquid ejecting head passes.

12. The liquid ejecting head unit according to claim 1, wherein the unit base has a step on an outer side of the wall portion, which accommodates a relay substrate that is common to and is electrically connected to the plurality of liquid ejecting heads.

13. A liquid ejecting apparatus comprising:

the liquid ejecting head unit according to claim 1.

14. A liquid ejecting head unit comprising:

a plurality of liquid ejecting heads that have a nozzle-forming surface; and a unit base that comprises a bottom portion having a fixing surface to which the plurality of liquid ejecting heads are fixed by either a screw or an adhesive, and a wall portion that extends from the bottom portion in a direction perpendicular to the fixing surface and that is continuous in a direction in which the plurality of liquid ejecting heads are aligned, wherein the plurality of liquid ejecting heads each include a plurality of head main bodies that have nozzle openings through which ink is ejected.

15. The liquid ejecting head unit according to claim 14, wherein the plurality of liquid ejecting heads are arranged in a row.

16. The liquid ejecting head unit according to claim 14, wherein the wall portion has a ring shape that continuously surrounds the plurality of liquid ejecting heads.

17. The liquid ejecting head unit according to claim 14, wherein the liquid ejecting head has a head-side fixing surface which is fixed to the fixing surface of the unit base, and is positioned on a side opposite to the nozzle-forming surface.

18. The liquid ejecting head unit according to claim 14, wherein the liquid ejecting head is fixed to a plurality of positions of the unit base in a short direction thereof.

19. The liquid ejecting head unit according to claim 18, wherein the liquid ejecting head has fixing positions in both ends in the short direction, of a plurality of fixing positions thereof, which are disposed in regions of both ends in a case where the bottom portion is divided into four regions in the short direction.

20. A liquid ejecting apparatus comprising:

the liquid ejecting head unit according to claim 14.

* * * * *